US011649980B2

(12) United States Patent
Chae et al.

(10) Patent No.: US 11,649,980 B2
(45) Date of Patent: May 16, 2023

(54) AIR CONDITIONER COMMUNICATING WITH MOVING AGENT TO SENSE INDOOR SPACE

(71) Applicant: LG ELECTRONICS INC., Seoul (KR)

(72) Inventors: Jonghoon Chae, Seoul (KR); Minook Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 446 days.

(21) Appl. No.: 16/499,069

(22) PCT Filed: Mar. 20, 2019

(86) PCT No.: PCT/KR2019/003244
§ 371 (c)(1),
(2) Date: Sep. 27, 2019

(87) PCT Pub. No.: WO2019/151845
PCT Pub. Date: Aug. 8, 2019

(65) Prior Publication Data

US 2020/0041156 A1 Feb. 6, 2020

(51) Int. Cl.

| | |
|---|---|
| ***F24F 11/46*** | (2018.01) |
| ***F24F 1/0007*** | (2019.01) |
| *F24F 110/40* | (2018.01) |
| *F24F 110/10* | (2018.01) |

(52) U.S. Cl.
CPC ..... *F24F 11/46* (2018.01); *F24F 1/00073* (2019.02); *F24F 2110/10* (2018.01); *F24F 2110/40* (2018.01)

(58) Field of Classification Search
CPC .... F24F 11/46; F24F 1/00073; F24F 2110/10; F24F 2110/40; G05D 1/0094
USPC ..... 700/276
See application file for complete search history.

(56) References Cited

U.S. PATENT DOCUMENTS

| | | | | |
|---|---|---|---|---|
| 2019/0202062 | A1* | 7/2019 | Park | B25J 13/089 |
| 2019/0206211 | A1* | 7/2019 | Lin | G06T 17/10 |
| 2020/0224913 | A1* | 7/2020 | Paddock | F24F 11/63 |

FOREIGN PATENT DOCUMENTS

| | | | |
|---|---|---|---|
| JP | 2006-317075 A | | 11/2006 |
| JP | 2006317075 A | * | 11/2006 |
| JP | 2007-147217 A | | 6/2007 |
| JP | 2007147217 A | * | 6/2007 |

(Continued)

*Primary Examiner* — Jigneshkumar C Patel
(74) *Attorney, Agent, or Firm* — Birch, Stewart, Kolasch & Birch, LLP

(57) ABSTRACT

An air conditioner is disclosed. An air conditioner according to an embodiment of the present disclosure comprises: a casing including a compressor, an inlet, and an outlet; a fan motor, installed inside the casing, for blowing air; a discharge vane provided movably in the outlet; a vane motor for operating the discharge vane; a communication unit for communicating with a moving agent moving in an indoor space; and a processor for receiving feature information related to a structure of the indoor space acquired by the moving agent, acquiring the type of the indoor space by using the feature information, and adjusting at least one of a set temperature, an airflow volume, and a wind direction by controlling at least one of the compressor, the fan motor, and the vane motor.

19 Claims, 22 Drawing Sheets

(56) References Cited

FOREIGN PATENT DOCUMENTS

| | | | | |
|---|---|---|---|---|
| KR | 10-2014-0132854 | A | | 11/2014 |
| KR | 10-2015-0122969 | A | | 11/2015 |
| KR | 10-2018-0017771 | A | | 2/2018 |
| KR | 20180017771 | A | * | 2/2018 |

* cited by examiner (a)

(b)

(a)

(b)

AIR CONDITIONER COMMUNICATING WITH MOVING AGENT TO SENSE INDOOR SPACE

CROSS REFERENCE TO RELATED APPLICATIONS

This application is the National Phase of PCT International Application No. PCT/KR2019/003244, filed on Mar. 20, 2019, which is hereby expressly incorporated by reference into the present application.

TECHNICAL FIELD

The present disclosure relates to an air conditioner capable of performing the optimal cooling by detecting the type of an indoor space or the situation of the indoor space using information received from a moving agent.

Artificial Intelligence, which is one field in a computer science and an information technology to study and research a manner allowing a computer to perform thinking, learning, or self-developing based on human intelligence, refers to allow the computer to emulate the intelligent behavior of a human being.

In addition, the artificial intelligence does not exist in itself, but is directly/indirectly significantly associated with other fields of a computer science. Especially, recently, artificial intelligence elements have introduced into several fields of the information technology, and have been actively attempted to be utilized in solving problems in relevant fields.

Meanwhile, technologies have been actively studied and researched to perceive and learn the surrounding situation using Artificial Intelligence, to provide information desired by the user in a desired form, or to perform an operation or function desired by the user.

Meanwhile, an air conditioner is a device for keeping the air present in a predetermined space in a most suitable state based on usage and purposes. In general, an air conditioner, which includes a compressor, a condenser, an expansion device, and an evaporator, may drive a cooling cycle for compressing, condensing, expanding, and evaporating for a refrigerant to cool or heat a predetermined space.

The predetermined space may be variously suggested depending on spaces for the air conditioner. For example, when the air conditioner is provided at home or at office, the predetermined space may be an indoor space of a house or a building.

Meanwhile, since the indoor space has various structures, the optimal cooling manner may be varied depending on the structure of the indoor space.

However, currently, since the cooling is performed according to user settings without considering the structure of the indoor space, the optimal cooling may be difficult.

In addition, it is necessary to perform intensive cooling depending on the situation of the indoor space. However, to consider various situations occurring in the indoor space, a plurality of sensors are necessary, thereby causing the increase of the costs.

DISCLOSURE

Technical Problem

The present disclosure has been suggested to solve the problem, and is to provide an air conditioner capable of performing the optimal cooling by detecting the type of an indoor space or the situation of the indoor space using feature information, which is associated with the structure of the indoor space, received from a moving agent.

The present disclosure is to provide an air conditioner capable of performing intensive cooling using situation information received from a moving agent.

Technical Solution

According to the air conditioner of an embodiment of the present disclosure, the type of the indoor space may be obtained using the feature information and at least one of the setting temperature, the wind volume, or the wind direction is adjusted using the type of the indoor space.

According to the air conditioner of an embodiment of the present disclosure, the situation information is received, and at least one of the setting temperature, the wind volume, or the wind direction is adjusted using the type of the indoor space and the situation information.

Advantageous Effects

Since the indoor space has various structures, the optimal cooling manner may be varied depending on the structure of the indoor space. However, according to the present disclosure, the optimal cooling may be performed based on the structure of the indoor space.

In addition, recently, a robot cleaner or the moving agent, such as a cleaning robot or a guide robot placed in an airport, a shopping mall, or a museum, has been increasingly utilized. In addition, according to the present disclosure, the optimal cooling may be performed after easily detecting the structure of the indoor space using the moving agent.

In addition, according to the present disclosure, the optimal cooling suitable for various purposes may be performed.

It is necessary to determine an area in which intensive cooling is performed based on the situation of the indoor space. However, various sensors are necessary to consider various situations occurring in the indoor space, thereby causing the increase of the costs. However, according to the present disclosure, after the situation of the indoor space is easily detected using the moving agent, the area requiring the intensive cooling may be determined and the optimal cooling may be performed based on even the structure of the indoor space.

BEST MODE

Figure 1A:
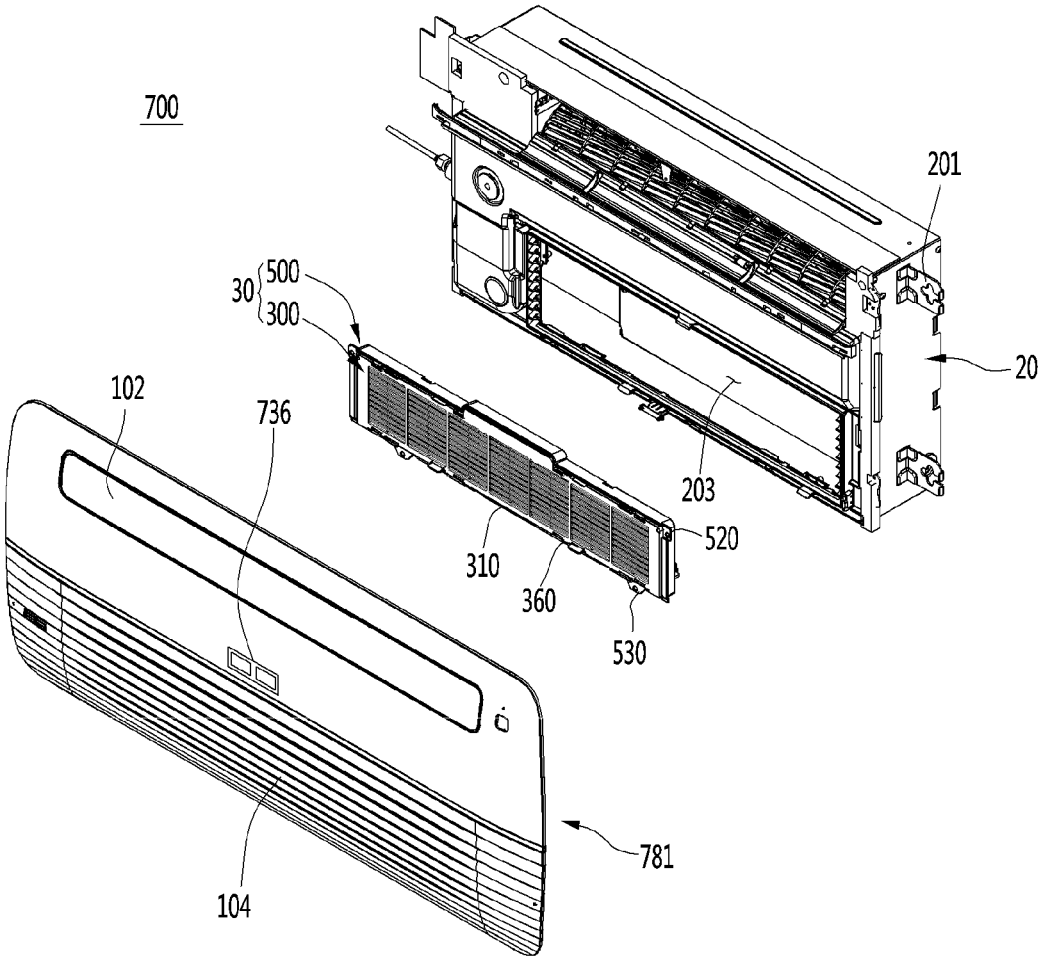
FIG. 1A is an exploded perspective view of an air conditioner according to an embodiment of the present disclosure.

Hereinafter, embodiments of the present disclosure are described in more detail with reference to accompanying drawings and regardless of the drawings symbols, same or similar components are assigned with the same reference numerals and thus overlapping descriptions for those are omitted. The suffixes "module" and "unit" for components used in the description below are assigned or mixed in consideration of easiness in writing the specification and do not have distinctive meanings or roles by themselves. In the following description, detailed descriptions of well-known functions or constructions will be omitted since they would obscure the invention in unnecessary detail. Additionally, the accompanying drawings are used to help easily understanding embodiments disclosed herein but the technical idea of the present disclosure is not limited thereto. It should be understood that all of variations, equivalents or substitutes contained in the concept and technical scope of the present disclosure are also included.

It will be understood that the terms "first" and "second" are used herein to describe various components but these components should not be limited by these terms. These terms are used only to distinguish one component from other components.

In this disclosure below, when one part (or element, device, etc.) is referred to as being 'connected' to another part (or element, device, etc.), it should be understood that the former can be 'directly connected' to the latter, or 'electrically connected' to the latter via an intervening part (or element, device, etc.). It will be further understood that when one component is referred to as being 'directly connected' or 'directly linked' to another component, it means that no intervening component is present.

The singular forms are intended to include the plural forms unless the context clearly indicates otherwise. It will be further understood that the terms "comprises," "comprising," "includes," or "including," or "having" specify the presence of stated features, numbers, steps, operations, components, parts, or the combination thereof, but do not preclude the presence or addition of one or more other features, numbers, steps, operations, components, components, and/or the combination thereof.

When the present disclosure is implemented, although components will be described by sub-dividing the components for the explanation of description, the components may be implemented in one device or module, or one component may be divided into a plurality of devices or modules to be implemented.

FIG. 1A is an exploded perspective view of an air conditioner according to an embodiment of the present disclosure.

Although various embodiments of the present disclosure has been described with reference to FIG. 1A in terms of a ceiling-type air conditioner by way of example, the embodiment of the present disclosure is not limited, but applicable to various types of air conditioners such as a stand-type air conditioner or a wall-mount-type air conditioner.

The outer appearance of the air conditioner illustrated in FIG. 1 is provided only for the illustrative purpose, and the outer appearance of the air conditioner according to an embodiment of the present disclosure is not limited thereto.

Referring to FIG. 1A, according to an embodiment of the present disclosure, an air conditioner 700 may include a casing. In this case, the casing may include a main body casing 20 and a front panel 781.

The casing may be fixed onto the ceiling or the wall to suction external air and discharge air which is heat-exchanged.

The main body casing 20 may include a fixed member 201 such that the main body casing 20 is fixed. To allow the main body casing 20 to make close contact with the ceiling or the wall, the fixed member 201 may be fixed by a coupling member such as a bolt (not illustrated).

A plurality of parts may be provided in the indoor space of the main body casing 20. The plurality of parts may include a heat exchanger (not illustrated) to exchange the heat of the air suctioned from the outside and a blowing fan (not illustrated) to discharge the air heat-exchanged in the heat exchanger to the outside.

The air conditioner 700 may further include a front panel 781 that may be coupled to a lower portion of the main body casing 20. When the main body casing 20 is buried in the ceiling through a celling-buried member such as a gypsum member, the front panel 781 is positioned at the substantially the same as the height of the ceiling and exposed to the outside. The whole outer appearance of the air conditioner 700 may be formed by the main body casing 20 and the front panel 781.

The casing may include an inlet to suction interior air and an outlet to discharge air, which is heat-exchanged by the air conditioner 700, to the interior.

In addition, the front panel 781 may further include a suction grill 104 to prevent foreign matters, which are contained in the air suctioned through the inlet, from being introduced. The suction grill 104 may be separately coupled to the inlet.

The inlet may be formed in a front portion of the front panel 781 while longitudinally extending in a lengthwise direction, and the outlet may be formed in a rear portion of the front panel 781 while longitudinally extending in the lengthwise direction.

The casing may further include an outlet vane 102 movably provided in the outlet. The outlet vane 102 may adjust the volume of wind discharged through the outlet or the direction of the wind.

In detail, the air conditioner 700 may include a vane motor to operate the outlet vane. In addition, the outlet vane 102 may be provided rotatably up and down about a hinge shaft (not illustrated) of the outlet vane 102.

In addition, the outlet vane 102 may receive driving force from the vane motor to rotate up and down, thereby adjusting the direction of the wind.

In the air conditioner 700, when the blowing fan is driven, the air in the indoor space may be suctioned into the casing through the inlet. In addition, the air suctioned into the casing may be heat-exchanged in the heat exchanger. In addition, the air having passed through the heat exchanger may be discharged into the indoor space through the outlet of the casing by the ventilation space.

Meanwhile, the main body casing 20 may include a suction port 203 formed to communicate with the inlet formed in the front surface of the front panel 781. In addition, the air conditioner 700 may include a filter assembly 30 disposed in the suction port 203. The filter assembly 30 may filter out foreign matters, such as dust contained in the air introduced into the air conditioner 700, to minimize foreign matters contained in air discharged through the outlet.

Meanwhile, the air conditioner, which includes a compressor to receive and compress a refrigerant, a condenser, an expansion device, and an evaporator, may drive a cooling cycle for compressing, condensing, expanding, and evaporating for a refrigerant to cool or heat an indoor space.

Hereinafter, components contained in the air conditioner according to an embodiment of the present disclosure will be described.

FIG. 1 B is a block diagram schematically illustrating components included in an air conditioner according to an embodiment of the present disclosure.

Figure 1B:
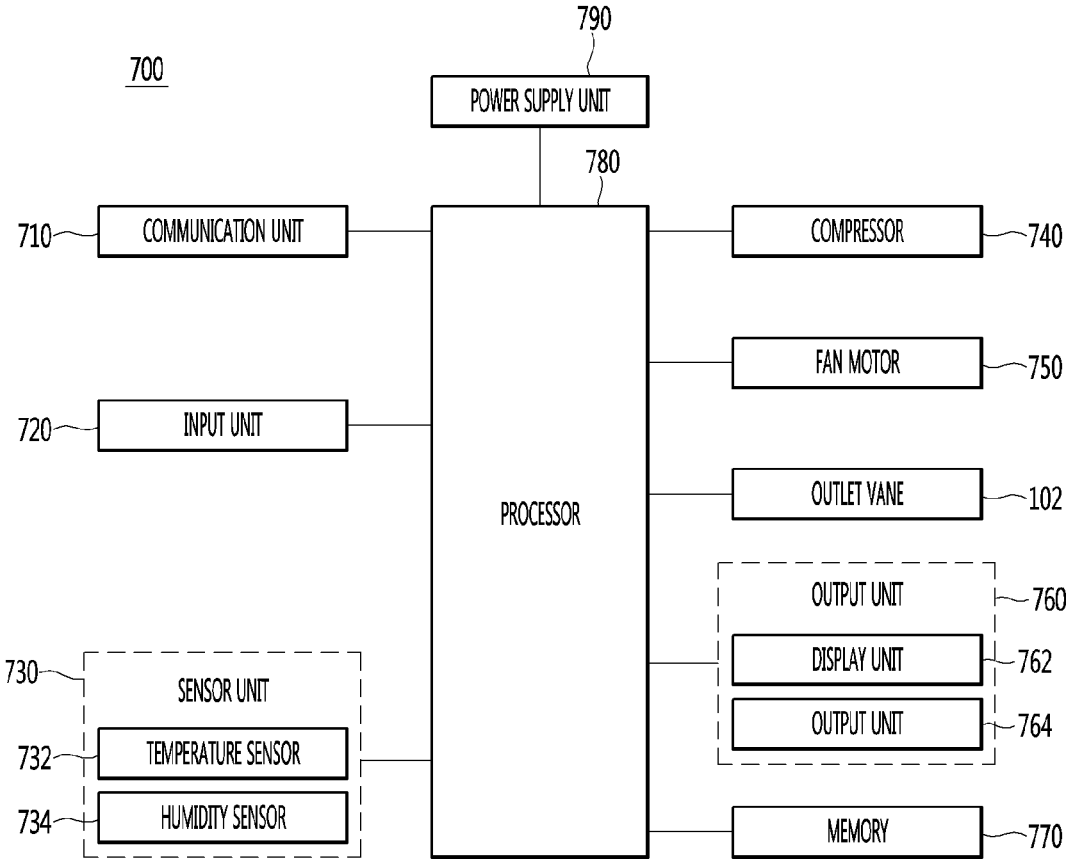
FIG. 1 B is a block diagram schematically illustrating components included in an air conditioner according to an embodiment of the present disclosure.

Referring to FIG. 1B, the air conditioner 700 may include a communication unit 710, an input unit 720, a sensor unit 730, a compressor 740, a fan motor 750, an output unit 760, a memory 770, a processor 780, and a power supply unit 790. The components illustrated in FIG. 1B are not essential components used to realize the air conditioner. Accordingly, the air conditioner according to an embodiment of the present disclosure may have a larger number of components or a smaller number of components as compared to the above components.

In more details, the communication unit 710 of the components may include one or modules for allowing the wired communication or the wireless communication between the air conditioner 700 and an external device (for example, a movable air conditioning device, such as a moving agent, a smartphone, or a tablet PC, or a fixing air conditioning device such as a desktop computer) or between the air conditioner 700 and an external server.

In addition, the communication unit 710 may include one or more modules for connecting the air conditioner 700 with one or more networks.

When the communication unit 710 supports wireless communication, the communication unit 710 may include at least one of a wireless internet module and a short range communication module.

The wireless internet module, which refers to a module for wireless internet access, may be embedded in or provided out of the air conditioner 700.

The wireless internet module is configured to transmit and receive wireless signals in a communication network according to wireless internet technologies. The wireless internet technologies may include, for example, a wireless LAN (WLAN), a wireless-fidelity (Wi-Fi), Wi-Fi Direct, or a digital living network alliance (DLNA).

The short range communication module, which is used for short range communication, may support short range communication using at least one of a technology such as Bluetooth™, Infrared Data Association (IrDA), ZigBee, or Near Field Communication (NFC). The short-range communication module may support wireless communication between the air conditioner 700 and an external device through a short range communication network (a wireless area network). The short range communication network may be a wireless personal area network.

Meanwhile, the communication unit 710 may make communication with the moving agent through various communication manners described above under the control of the processor 780.

The input unit 720 may include a touch key, a push key (mechanical key), or a dial key to receive information or a command from a user. According to an embodiment, the input unit 720 may be understood as a concept of totally including an interface unit that receives information or a command from a separate remote control.

In detail, the input unit 720, which is to receive information from a user, and when the information is input through the input unit 720, the processor 780 may control the operation of the air conditioner 700 to correspond to the input information.

The input unit 720 may be a mechanical input unit (or a mechanical key, for example, a button, a dome switch, a jog wheel, or a jog switch positioned at the front or rear surface or the side surfaces of the air conditioner 700) and a touch input unit.

For example, the touch input unit may include a virtual key, a soft key, or a visual key displayed on a touchscreen through software processing or may include a touch key disposed in a portion other than the touch screen.

Meanwhile, the virtual key or visual key may be displayed on the touch screen with various forms, and for example, may have the form of a graphic, text, icon, video or the combination thereof.

The sensor unit 730 may include one or more sensors to sense at least one of information on a surrounding environment, which surrounds the air conditioner 700 or user information.

For example, the sensor unit 730 may include a temperature sensor 732 to detect the temperature of the space in which the air conditioner 700 is installed, and a humidity sensor 734 to detect the humidity of the space.

The output unit 760, which is to generate a visible or audible output, may include at least one of a display unit 762 or a sound output unit 764 (for example, a speaker).

The display unit 762 may form a layer structure together with the touch sensor or be integrated with the touch sensor, thereby realizing a touch screen. The touch screen, which functions as the input unit 720 providing an input interface between the air conditioner 700 and the user, may provide an output interface between the air conditioner 700 and the user.

The display unit 762 may display various pieces of information associated with the operation of the air conditioner 700. For example, the display unit 762 may display information, such as a setting temperature, a wind volume, a wind direction, a current interior temperature, or a current interior humidity of the air conditioner 700, and information on an operating mode such as a power saving mode, a normal mode, or a sleep mode.

The sound output unit 764 may output a signal in the form of a voice to inform the occurrence of an event of the air conditioner 700. Examples of events occurring in the air conditioner 700 may include an Alarm, Power on/off, Error Occurrence, or Operation mode change.

The memory 770 stores data for supporting various functions of the air conditioner 700. The memory 770 may store various data and instructions for the operation of the air conditioner 700.

The memory 770 may include a storage medium in at least one of a flash memory type, a hard disk [0061] type, a solid state disk type (SSD), a Silicon Disk Drive (SDD) type), a multimedia card micro type, a card type memory (e.g. SD or XD memory), a random access memory (RAM), a static random access memory (SRAM), a read-only memory (ROM), an electrically erasable programmable read-only memory (EEPROM), a programmable read-only memory (PROM), a magnetic memory, a magnetic disk, or an optical disk type.

The processor 780 typically controls the overall operation of the air conditioner 700. The processor 780 may provide or process information or a function appropriate to a user by processing signals, data, or information input or output through the above-described components.

The processor 780 may adjust at least one of the compressor 740, the fan motor 750, and the vane motor based on the cooling information of the air conditioner 700.

In this case, the cooling information may include at least one of a setting temperature, a wind volume, and a wind direction.

The fan motor 750 is installed in the casing to rotate a blowing fan (not illustrated) provided in the casing to blow air.

In other words, when the fan motor 750 is driven, a blowing fan rotates, and as the blowing fan rotates, air is suctioned through the inlet and air is discharged through the outlet.

For example, the processor 780 may control the operation of the compressor 740 based on the setting temperature of the cooling information. As the operation of the compressor 740 is controlled, the setting temperature of the air conditioner 780 may be adjusted.

In addition, the processor 780 may control the operation of the fan motor 750 based on the wind volume of the cooling information. As the operation of the fan motor 750 is controlled, the wind volume of the air conditioner 780 may be adjusted.

In addition, the processor 780 may control the operation of the vane motor based on the wind direction of the cooling information. As the operation of the vane motor is controlled, the wind direction of the air conditioner 780 may be adjusted.

The power supply unit 790 is supplied with external power and internal power under the control of the processor 780 to supply power to each component included in the air conditioner 700.

At least some of the components may operate in cooperation with each other to realize an operation, control, or control method of the air conditioner according to various embodiments described below. The operation, control, or control method of the air conditioner may be realized on the air conditioner due to the driving of at least one application program stored in the memory 770.

Hereinafter, a robot cleaner will be described by way of example of the moving agent. However, the moving agent is not limited to the robot cleaner, and may include all devices, such as a pet robot, or a guide robot, that are movable in the indoor space.

Figure 2A:
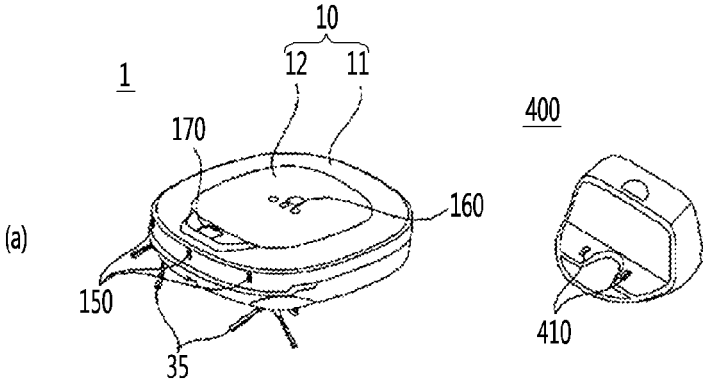
FIG. 2A is a perspective view of a robot cleaner according to an embodiment of the present disclosure.
Figure 2A:
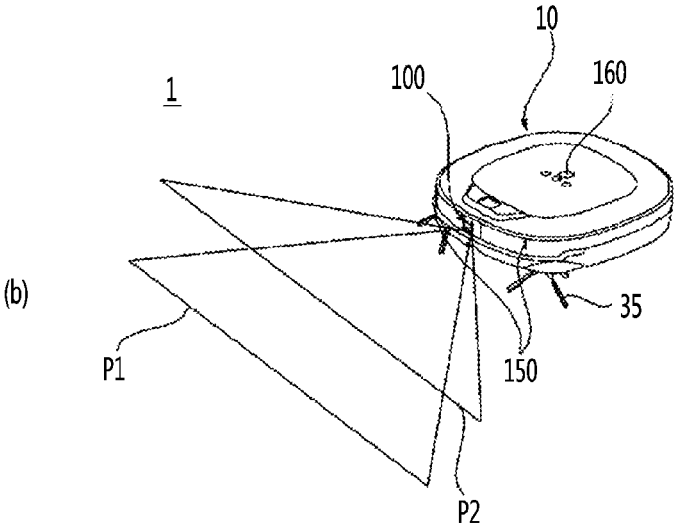
Figure 2B:
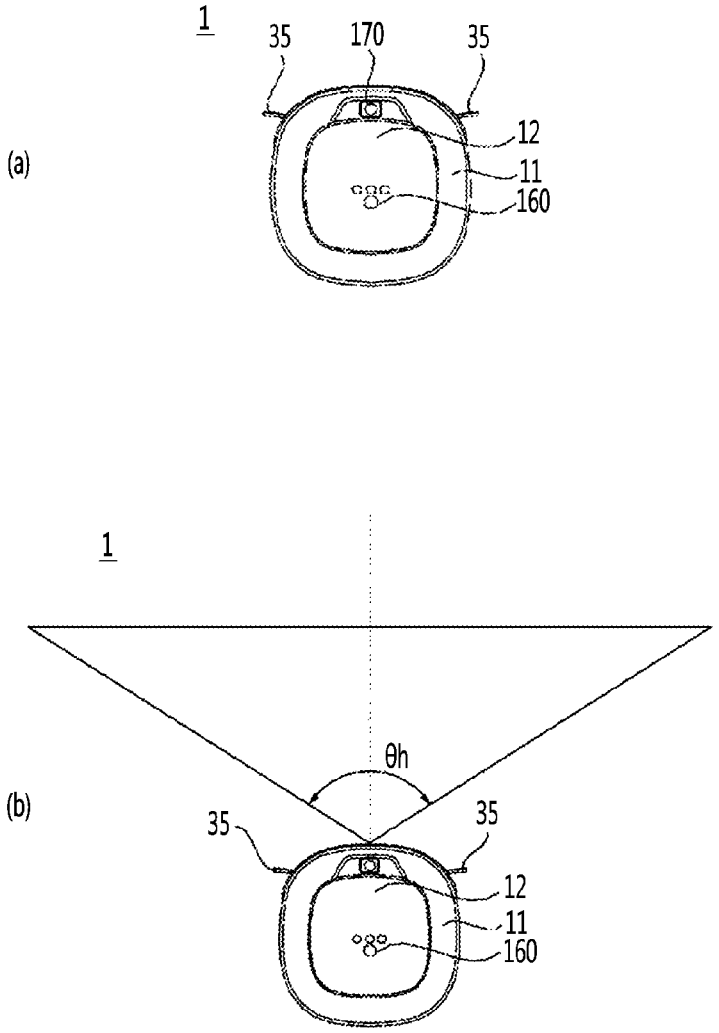
FIG. 2B illustrates a horizontal field of viewing of a robot cleaner of FIG. 2A.
Figure 2C:
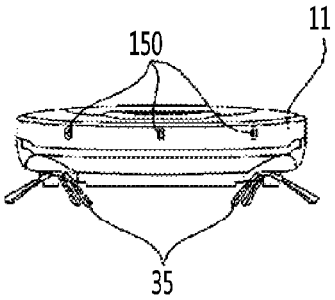
FIG. 2C is a front view of a robot cleaner of FIG. 2A.
Figure 2C:
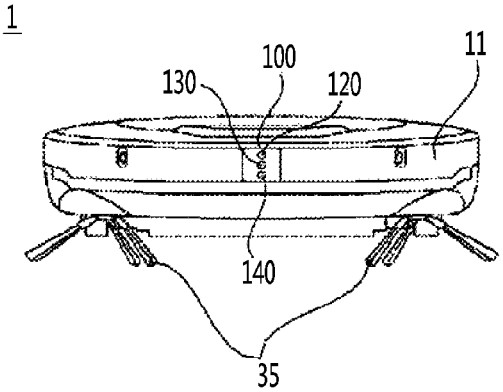
Figure 2D:
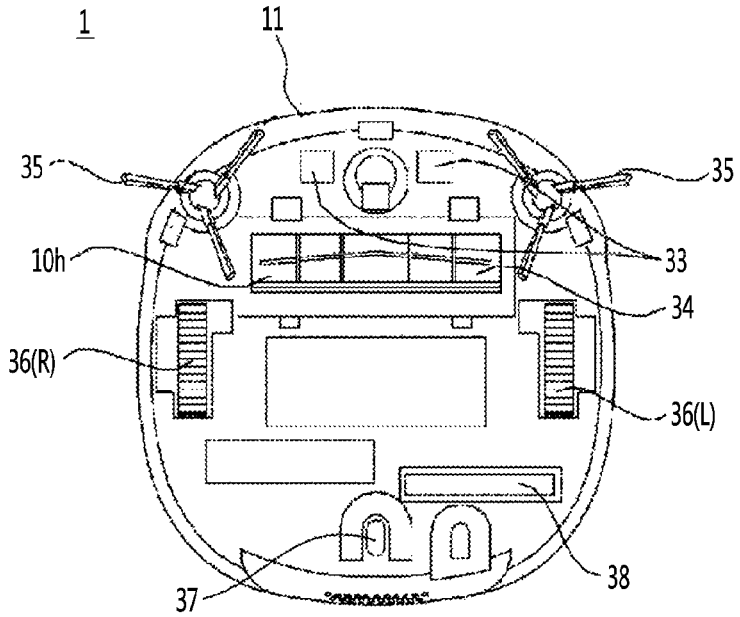
FIG. 2D illustrates a bottom view of a robot cleaner of FIG. 2A.

FIG. 2A is a perspective view of the robot cleaner according to an embodiment of the present disclosure. FIG. 2B illustrates a horizontal field of viewing of the robot cleaner of FIG. 2A. FIG. 2C is a front view of the robot cleaner of FIG. 2A. FIG. 2D illustrates a bottom view of the robot cleaner of FIG. 2A.

Referring to FIGS. 2A to 2D, according to an embodiment of the present disclosure, the robot cleaner 1 may move along the floor of a cleaning zone of the robot cleaner 1 to suction foreign matters on the floor, and may include a main body 10 and an obstacle sensing unit 100 disposed on a front surface of the main body 10.

The main body 10 may include a casing 11, which forms an outer appearance and has a space formed inward to receive parts constituting the main body 10, a suction unit 34 provided in the casing 11 to suction foreign matters such as dust or garage, and a left wheel 36L and a right wheel 36R rotatably provided in the casing 11. As the left wheel 36L and the right wheel 36R rotate, the main body 10 moves along the floor of the cleaning zone while suctioning the foreign matters through the suction unit 34.

The suction unit 34 may include a suction fan (not illustrated) to generate suction force and a suction port 10*h* through which an air flow generated by the rotation of the suction fan is suctioned. The suction unit 34 may include a filter (not illustrated) which collects foreign matters from the air flow suctioned through the suction port 10*h*, and a foreign matter collecting container (not illustrated) in which foreign matters collected by the filter are accumulated.

In addition, the main body 10 may include a driving unit which drives the left wheel 36L and the right wheel 36R. The driving unit may include at least one driving motor. The at least one driving motor may include a left wheel driving motor to rotate the left wheel 36L and a right wheel driving motor to rotate the right wheel 36R.

The left wheel driving motor and the right wheel driving motor may allow the main body 10 to move straightly ahead, move rearward or turn as the operations of the left wheel driving motor and the right wheel driving motor are independently controlled by a driving control unit of a controller. For example, when the main body 10 straightly travels, the left wheel driving motor and the right wheel driving motor rotate in the same direction. However, when the left wheel driving motor and the right wheel driving motor rotate at mutually different speeds or in opposite directions, the traveling direction of the main body 10 may be changed. At least one auxiliary wheel 37 may be further provided to stably support the main body 10.

A plurality of brushes 35, which are positioned in a front portion of the casing 11 and include a plurality of blades extending radially and have bristles, may be further provided. As the plurality of brushes 35 rotate, dust may be removed from the floor of the cleaning zone, and the dust separated from the floor may be suctioned through the suction port 10*h* and collected in the collection container.

A control panel including an operating unit 160 to receive various types of commands for controlling the robot cleaner 1 from a user may be provided on the top surface of the casing 11.

The obstacle sensing unit 100 may be disposed on the front surface of the main body 10.

The obstacle sensing unit 100 is fixed onto the front surface of the casing 11 and includes a first pattern irradiation unit 120, a second pattern irradiation unit 130, and an image acquisition unit 140. Although the image acquisition unit is basically installed under pattern irradiation units, the image acquisition unit may be interposed between the first and second pattern irradiation units if necessary. In addition, a second image acquisition unit (not illustrated) may be further provided at an upper portion of the main body. The second image acquisition unit may capture an image of the upper end of the main body, that is, the ceiling.

The main body 10 may include a battery 38 which is rechargeable. As a charging connector 33 of the battery 38 is connected with a power supply (for example, an power outlet at home), or the main body 10 is docked on a charging member (not illustrated), which is separately provided and connected with the power supply, the charging connector 33 is electrically connected with the power supply such that the battery 38 is charged with power. Electronic parts constituting the robot cleaner 1 may receive power from the battery 38. Accordingly, in the state that the battery 38 is charged with power, the robot cleaner 1 may self-drive without being electrically disconnected from the power supply.

Figure 2E:
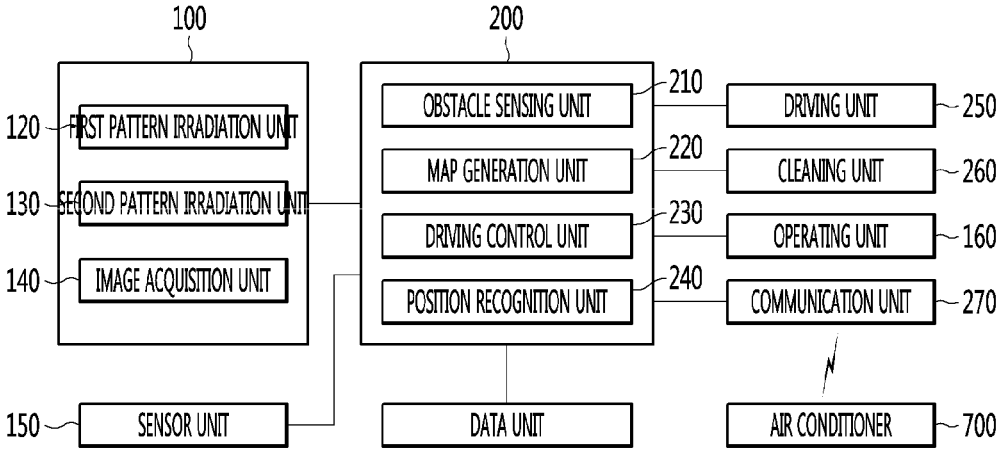
FIG. 2E is a block diagram illustrating main components of a robot cleaner according to an embodiment of the present disclosure.

FIG. 2E is a block diagram illustrating main components of the robot cleaner according to an embodiment of the present disclosure.

As illustrated in FIG. 2E, the robot cleaner 1 may include a driving unit 250, a cleaning unit 260, a data unit 280, an obstacle sensing unit 100, a sensor unit 150, a communication unit 270, an operating unit 160, and a control unit 200 to control the overall operation. The control unit may be realized with one or more microprocessors, and may be realized with a hardware device.

The operating unit 160 receives a user command including an input unit such as at least one button, a switch, or a touch pad. As described above, the operating unit may be provided at an upper end of the main body 10.

The data unit 280 may store an obstacle sensing signal input from the obstacle sensing unit 100 or the sensor unit 150, store reference data used for the obstacle recognition unit 210 to determine the obstacle, and information on the sensed obstacle. In addition, the data unit 280 stores control data for controlling the operation of the robot cleaner, data resulting from the cleaning mode of the robot cleaner, and a map including the information on the obstacle, which is generated from a map generation unit. The data unit 280 may sore a basic map, a cleaning map, a user map, or a guide map. The obstacle sensing signal may include a signal sensed by the sensor unit through an ultrasonic wave/a laser beam.

In addition, the data unit 280, which is to store data readable by a micro-processor, may include a hard disk drive (HDD), a solid state disk (SSD), a silicon disk drive (SDD), a ROM, a RAM, a CD-ROM, a magnetic tape, a floppy disk, or an optical data storage device.

The communication unit 270 may make communication with an air conditioner through a wireless communication scheme. In addition, the communication unit 270 may be connected with the Internet network through a home network to make communication with an external server or an air conditioner.

The communication unit 270 transmits the generated map to the air conditioner, and transmits data on the operation state and the cleaning state of the robot cleaner to the air conditioner. The communication unit 270 includes communication modules, for example Wi-Fi and WiBro, as well as short range wireless communication such as Zigbee and Bluetooth to transmit and receive data.

The driving unit 250 includes at least one driving motor to allow the robot cleaner to travel according to a control command of a driving control unit 230. As described above, the driving unit 250 may include a left wheel driving motor for rotating a left wheel 36L and a right wheel driving motor for rotating a right wheel 36R.

The cleaning unit 260 operates a brush to make it easy to suction dust or foreign matters around the robot cleaner, and operates a suction device to suction the dust or the foreign matter. The cleaning unit 260 controls the operation of the suction fan provided in the suction unit 34 to suction foreign matters, such as dust or garbage, such that the dust is introduced into the foreign matter collecting container through the suction port.

The obstacle sensing unit 100 includes the first pattern irradiation unit 120, the second pattern irradiation 130, and the image acquisition unit 140.

The sensor unit 150 includes a plurality of sensors to assist the sensing of a failure. The sensor unit 150 may include at least one of a laser sensor, an ultrasonic sensor, or an infrared sensor. The sensor unit 150 senses an obstacle in front of the main body 10, that is, a traveling direction, by using at least one of a laser beam, an ultrasonic wave, and an infrared ray. When the transmitted signal is reflected and input, the sensor unit 150 inputs, to the control unit 200, information, which serves as a sensing signal, on whether the obstacle is present or the distance to the obstacle In addition, the sensor unit 150 includes at least one inclination sensor to sense the inclination of the main body. The inclination sensor calculates the inclined direction and the inclined angle when the main body is inclined forward, rearward, leftward or rightward. The inclination sensor may include a tilt sensor or an acceleration sensor, and the acceleration sensor may be employed in any one of a gyro type, an inertial type, and a silicon semiconductor type.

Meanwhile, the sensor unit 150 may include at least one of the components of the obstacle sensing unit 100 and may perform a function of the obstacle sensing unit 100.

As the first pattern irradiation unit 120, the second pattern irradiation unit 130, and the image acquisition unit 140 are installed on the front surface of the main body 10 to irradiate light P1 and P2 having the first and second patterns, the obstacle sensing unit 100 may acquire an image by taking the irradiated light having pattern.

The obstacle sensing unit 100 inputs the acquired image, which serves as an obstacle detecting signal, to the control unit 200.

The first and second pattern irradiation units 120 and 130 of the obstacle sensing unit 100 may include a light source and an optical pattern projection element (OPPE) to generate a predetermined pattern by transmitting light emitted from the light source. The light source may be a laser diode (LD) or a light emitting diode (LED). Laser light is superior to other light sources in terms of monochromaticity, straightness, and connection characteristics, so accurate distance measurement is possible. In particular, the LD is preferred as a light source because infrared light or visible light makes great deviation in the accuracy of the distance measurement depending on causes such as the color or the material of the target. The OPPE may include a lens or a diffractive optical element (DOE). The light having various patterns may be irradiated according to the configuration of the OPPE provided in the pattern irradiation units 120 and 130.

The first pattern irradiation unit 120 may irradiate the light P1 (hereinafter, referred to as first pattern light) having the first pattern toward the front lower portion of the main body 10. Therefore, the first pattern light P1 may be incident on the floor of the cleaning zone.

The first pattern light P1 may be configured in the form of a horizontal line Ph. In addition, the first pattern light P1 may be configured in the form of a cross pattern in which the horizontal line Ph crosses the vertical line Pv.

The first pattern irradiation unit 120, the second pattern irradiation unit 130, and the image acquisition unit 140 may be vertically arranged in a line. Although the image acquisition unit 140 is provided under the first pattern irradiation unit 120 and the second pattern irradiation unit 130, the present disclosure is not limited thereto. For example, the image acquisition unit 140 may be provided above the first pattern irradiation unit 120 and the second pattern irradiation unit 130.

In an embodiment, the first pattern irradiation unit 120 is positioned above to irradiate the first pattern light P1 downward forward to sense an obstacle positioned under the first pattern irradiation unit 120, and the second pattern irradiation unit 130 is positioned under the first pattern irradiation unit 120 to irradiate the light P2 having the second pattern (hereinafter, referred to as a "second pattern light" upward forward. Accordingly, the second pattern light P2 may be incident onto an obstacle, which is positioned at least higher than the second pattern irradiation unit 130 from the wall surface or the cleaning zone, or a portion of the obstacle.

The second pattern light P2 may be formed in a different pattern from the first pattern light P1, and preferably includes a horizontal line. In this case, the horizontal line is not a continuous line segment, and may include a dotted line.

Meanwhile, in FIG. 2 described above, an irradiation angle θh, which is shown, indicates the horizontal irradiation angle of the first pattern light P1 irradiated from the first pattern irradiation unit 120, and indicates an angle in which opposite ends of the horizontal line Ph is formed with the first pattern irradiation unit 120. The irradiation angle θh is preferably determined in the range of 130° to 140°, but the present disclosure is not necessarily limited thereto. The dotted line shown in FIG. 2 is directed to the front of the robot cleaner 1, and the first pattern light P1 may have a symmetrical shape about the dotted line.

Similarly to the first pattern irradiation unit 120, in the second pattern irradiation unit 130, the horizontal irradiation angle may be preferably determined in the range of 130° to 140°. According to an embodiment, the second pattern irradiation unit 130 may irradiate the second pattern light P2 with the horizontal irradiation angle the same as that of the first pattern irradiation unit 120. In this case, even the second pattern light P1 may be formed in the symmetrical shape about the dotted line illustrated in FIG. 2.

The image acquisition unit 140 may acquire an image of the front of the main body 10. In particular, the pattern light P1 and P2 appear in an image (hereinafter, referred to as an acquired image) acquired by the image acquisition unit 140. Hereinafter, the images of the pattern light P1 and P2 appearing on the acquired image are referred to as optical patterns. The optical patterns are actually images on an image sensor by the pattern lights P1 and P2 incident in the air. Accordingly, reference numerals are assigned with the pattern lights P1 and P2, and the images corresponding to the first pattern light P1 and the second pattern light P2 will be named the first optical pattern P1 and the second optical pattern P2.

The image acquisition unit 140 may include a digital camera which converts an image of the subject into an electrical signal, converts the electrical signal into a digital signal, and allows the digital signal to be stored in a memory device. The digital camera may include an image sensor (not illustrated) and an image processing unit (not illustrated).

An image sensor is a device that converts an optical image into an electrical signal, and is provided in the form of a chip in which a plurality of photo diodes are integrated. For example, a pixel may be a photodiode. Charges are accumulated in each pixel by an image formed on the chip by light passing through the lens, and the charges accumulated in the pixels are converted into electrical signals (e.g., voltages). A charge coupled device (CCD), a complementary metal oxide semiconductor (CMOS) are well known to the image sensor.

An image processing unit generates a digital image based on the analog signal output from the image sensor. The image processing unit includes an AD converter which converts an analog signal into a digital signal, a buffer memory which temporarily records digital data in response to a digital signal output from the AD converter, and a digital signal processor (DSP) which forms a digital image by processing information recorded in the buffer memory.

The control unit 200 includes an obstacle recognition unit 210, a map generation unit 220, a driving control unit 230, and a position recognition unit 240.

The obstacle recognition unit 210 determines an obstacle based on the acquired image input from the obstacle sensing unit 100, and the driving control unit 230 controls the driving unit 250 to travel while passing through the obstacle or avoiding the obstacle by changing the moving direction or the traveling path based on the obstacle information.

The driving control unit 230 controls the driving unit 250 to independently control the operations of the left wheel driving motor and the right wheel driving motor such that the main body 10 travels straight or rotated.

The obstacle recognition unit 210 stores an obstacle detection signal input from the sensor unit 150 or the obstacle sensing unit 100 in the data unit 280, and analyzes the obstacle detection signal to determine the obstacle.

The obstacle recognition unit 210 determines the presence of an obstacle in front of the obstacle recognition unit 210 based on the signal of the sensor unit, and analyzes the acquired image to determine the position, size, and shape of the obstacle.

The obstacle recognition unit 210 extracts a pattern by analyzing the acquired image. The obstacle recognition unit 210 extracts an optical pattern formed as light having patterns and irradiated by the first pattern irradiation unit or the second pattern irradiation is irradiated onto the floor or the obstacle, and determines the obstacle based on the extracted optical pattern.

The obstacle recognition unit 210 detects optical patterns P1 and P2 from the image (acquired image) acquired by the image acquisition unit 140. The obstacle recognition unit 210 may detect a feature such as a point, a line, a surface, or the like with respect to predetermined pixels constituting the acquired image, and detect the optical patterns P1 and P2 or a point, a line, a plane, and the like constituting the optical patterns P1 and P2.

The obstacle recognition unit 210 may extract line segments formed by successive pixels that are brighter than the surrounding, and may extract the horizontal line Ph forming the first optical pattern P1 and the horizontal line forming the second optical pattern P2. However, the present disclosure is not limited thereto. For example, since various schemes to extract patterns having desired shapes from the digital image are well known, the obstacle recognition unit 210 may extract the first optical pattern P1 and the second optical pattern P2 through the well-known technologies.

In addition, the obstacle recognition unit 210 determines the presence of the obstacle based on the detected pattern, and determines the shape of the obstacle. The obstacle recognition unit 210 may determine the obstacle through the first optical pattern and the second optical pattern, and may calculate a distance to the obstacle. In addition, the obstacle recognition unit 210 may determine the size (height) and the shape of the obstacle based on the shapes of the first optical pattern ad the second optical pattern and the change of the optical pattern shown while the obstacle is approaching.

The obstacle recognition unit 210 determines the obstacle based on the distance from the reference position with respect to the first and second optical patterns. When the first optical pattern P1 is shown at a position lower than the reference position, the obstacle recognition unit 210 may determine that the downhill slope exists, and may determine that there is present a cliff when the first optical pattern P1 disappears. In addition, when the second optical pattern appears, the obstacle recognition unit 210 may determine a front obstacle or an upper obstacle.

The obstacle recognition unit 210 determines whether the main body is inclined based on the inclination information input from the inclination sensor of the sensor unit 150. When the main body is inclined, the obstacle recognition unit 210 compensates for the inclination with respect to the position of the optical pattern of the acquired image.

The driving control unit 230 controls the driving unit 250 to travel in a specified area of the cleaning zone while performing the cleaning, and to control the cleaning unit 260 to suction the dust while driving to perform the cleaning.

The driving control unit 230 determines whether the traveling is possible or entrance is possible, corresponding to the obstacle recognized from the obstacle recognition unit 210, sets a traveling path to approach the obstacle while traveling, passing through the obstacle, or avoiding the obstacle, and controls the driving unit 250.

The map generation unit 220 generates a map of the cleaning zone based on the information on the obstacle determined by the obstacle recognition unit 210.

The map generation unit 220 generates a map for the cleaning zone based on the obstacle information while the robot cleaner is traveling in the cleaning area during the initial operation or when the map for the cleaning zone is not stored. In addition, the map generation unit 220 updates the previously generated map based on the obstacle information acquired while the robot cleaner is traveling.

The map generation unit 220 generates a basic map based on information obtained by the obstacle recognition unit 210 while the robot cleaner is driving, and generates a cleaning map by dividing an area from the basic map. In addition, the map generation unit 220 organizes areas for the cleaning map, and sets the attributes for the areas, thereby generating a user map and a guide map.

The basic map is a map in which the shape of the cleaning zone obtained through traveling is marked in the form of a contour and the cleaning map is a map formed by dividing the areas of the basic map. The basic map and the cleaning map include information on an area for allowing the traveling of the robot cleaner and obstacle information. The user map is a map processed by simplifying the area of the cleaning map and organizing the outlines and having a visual effect. The guide map is a map having the clean map and the user map overlapped with each other. Since the cleaning map is displayed on the guide map, a cleaning command may be input into the guide map based on an area for allowing the actual traveling of the robot cleaner.

After generating the basic map, the map generation unit 220 generates a map by dividing the cleaning zone into a plurality of areas, including a connection passage to connect the areas with each other, and including information on the obstacle in each area. The map generation unit 220 may generates a map having divided areas by dividing an area on the map into smaller areas, setting a representative area, setting the divided smaller area to separate detailed areas, and merging the detailed areas into the representative area.

The map generation unit 220 processes the shape of an area with respect to divided areas. The map generation unit 220 sets an attribute with respect to the divided area and processes the shape of the area with respect to the attribute of each area.

The map generation unit 220 first determines the main area based on the number of contacts with other areas in each of the divided areas. Although the main area is basically a living room, the main area may be changed to any one of a plurality of rooms if necessary. The map generation unit 220 sets attributes of the remaining areas based on the main area. For example, the map generation unit 220 may set an area in a predetermined size or more, which is arranged around the living room, which is a main area, as a room, and remaining areas as other areas.

The map generation unit 220 processes the shape of areas such that each area has a specific shape based on the reference depending on the attribute of the area when the shape of the area is processed. For example, the map generation unit 220 processes the shape of the area to become the shape of the typical house room, for example, the rectangular shape. In addition, the map generation unit 220 expands the shape of the area based on the outermost cell of the basic map and processes the shape of the area by deleting or downscaling areas that do not allow the access due to the obstacle.

In addition, the map generation unit 220 displays an obstacle having a predetermined size or more on the map depending on the size of the obstacles in the basic map and deletes a relevant cell such that an obstacle having less than a predetermined size is deleted from the basic map. For example, the map generation unit 220 displays furniture, such as a chair or a sofa, having a predetermined size or more, on the map and deletes an obstacle, which temporarily appears, or a smaller obstacle, such as a toy, from the map. The map generation unit 220 stores the position of the charging member together with the map when the map is generated.

The map generation unit 220 may add an obstacle on the map based on obstacle information input from the obstacle recognition unit 21, with respect to the sensed obstacle, after generating the map. When the specific map is repeatedly sensed at a specific position, the map generation unit 220 adds the obstacle on the map. When the obstacle is temporarily sensed, the map generation unit 220 ignores the obstacle.

The map generation unit 220 generates both the user map which is a processed map, and a guide map having the user map and the cleaning map overlapped with each other.

In addition, when a virtual wall is set, the map generation unit 220 sets a position of the virtual wall on the cleaning map based on the virtual wall, which is received through the communication unit, and calculates the coordinates of the virtual wall corresponding to the cleaning zone. The map generation unit 220 registers the virtual wall as the obstacle in the cleaning map.

The map generation unit 220 stores data on the set virtual wall, for example, information on the level of the virtual wall or the attribute of the virtual wall.

The map generation unit 220 registers the set virtual wall as the obstacle by expanding the range of the obstacle. The map generation unit 220 sets the range of the virtual wall to a wider range such that the main body 10 does not make contact with the virtual wall or invade the virtual wall.

The map generation unit 220 generates a new map for the cleaning zone when the current position of the main body 10 is not determined by the position recognition unit 240. The map generation unit 220 initializes the preset virtual wall as the robot cleaner moves into a new area.

When data on the virtual wall is collected during the traveling of the main body 10, the map generation unit 220 adds and sets the virtual wall on the map such that the main body 10 operates corresponding to the virtual wall when the main body 10 is traveling. For example, when a new virtual wall is added or the level or the attribute of the virtual wall is changed, or when the virtual wall of the preset virtual wall is changed, the map generation unit 220 updates a map based on the received data such that information on the changed virtual wall is reflected in the map.

The position recognition unit 240 determine the present position of the main body 10 based on a map (the cleaning map, the guide map, or the user map) stored in the data unit.

The position recognition unit 240 determines whether the position on the map is matched with the present position of the main body 10 when the cleaning command is input. Thereafter, when the position on the map is matched to the present position of the main body 10, or when the present position is not determined, the position recognition unit 240 recovers the present position of the robot cleaner 1 by recognizing the present position. The driving control unit 230 controls the driving unit to move to a specific position based the present position when the present position is recovered. The cleaning command may be input from a remote control (not illustrated), the operating unit 160, or the air conditioner.

The position recognition unit 240 may estimate the present position based on the map by analyzing the acquisition image input from the image acquisition unit 140, when the present position is not matched to the position on the map, or when the present position is not determined.

The position recognition unit 240 processes acquisition images acquired at each position and links the acquisition images with the map while the map is generating by the map generation unit 220.

The position recognition unit 240 compares the map and the acquisition image for each position on the map using the acquisition image of the image acquisition unit 140, thereby detecting the present position of the main body. Accordingly, even if the position of the main body is abruptly changed, the present position may be estimated and recognized.

The position recognition unit 240 determines the position by analyzing several features of lights positioned on the ceiling, an edge, a corner, a blob, or a ridge, which are included in the acquisition image. The acquisition image may be input from the second image acquisition unit provided in the image acquisition unit or provided at the upper end of the body.

The position recognition unit 240 detects features from each of the acquisition images. In a computer vision technical field, various manners (feature detection) of detecting the feature from the image are well known. Several feature detectors appropriate to the detection of the feature are well known. For example, there are detectors such as Canny, Sobel, Harris&Stephens/Plessey, SUSAN, Shi&Tomasi, Level curve curvature, FAST, Laplacian of Gaussian, Difference of Gaussians, Determinant of Hessian, MSER, PCBR, Grey-level blobs.

The position recognition unit 240 calculates a descriptor based on each feature. The position recognition unit 240 may convert the feature point into the descriptor using Scale Invariant Feature Transform (SIFT) for detecting the feature. The descriptor may be described in the form of an n-dimension vector. According to the SIFT, invariant features may be detected with respect to the scale, the rotation, the variation in brightness of a target to be photographed. Accordingly, even if the same area is photographed while the postures of the robot cleaner 1 are changed, the invariant feature (that is, rotation-invariant) may be detected. Surely, the present disclosure is not limited thereto, and various schemes (for example, Histogram of Oriented Gradient (HOG), Haar feature, Fems, Local Binary Pattern (LBP), or Modified Census Transform (MCT) may be employed.

The position recognition unit 240 classifies at least one descriptor into a plurality of group according to a predetermined sub-classification rule with respect to each acquisition image, based on information on the descriptor obtained through the acquisition mage of each position and may convert each of the descriptors included in the same group into a sub-representative descriptor according to the predetermined sub-classification rule. For another example, all descriptors collected from the acquisition images in the predetermined zone such as a room may be classified into a plurality of groups according to a predetermined sub-classification rule and each of the descriptors included in the same group may be converted to the sub-representative descriptor according to the predetermined sub-representative rule.

The position recognition unit 240 may find the feature distribution of each position through the above procedures. The feature distribution of each position may be expressed in the form of a histogram or an n-dimension vector. For another example, the learning module 143 may estimate an unknown present position based on a descriptor calculated from each feature point without passing through a predetermined sub classification rule and a predetermined sub-representative rule.

In addition, when the present position of the robot cleaner 1 is in an unknown state due to the jumping, the position recognition unit 240 may estimate the present position based on data such as the previously-stored descriptor or the sub-representative descriptor.

When the position recognition unit 240 acquires an acquisition image through the image acquisition unit 140 at a present current position, and several features, such as lights, edges, corners, and blobs positioned on the ceiling, are determined through the image. When various features such as a ridge and the like are identified, the features are detected from the acquired image, and the position recognition unit 240 detects the features from the acquisition image.

The position recognition unit 240 converts position information (for example, the feature distribution at each position) of a target to be compared to comparable information (sub-recognition feature distribution) according to the predetermined sub-conversion rule, based on at least one piece of descriptor information obtained through the acquisition image at the unknown present position. According to the predetermined sub-comparison rule, the feature distribution at each position is compared with each recognition feature distribution to calculate the respective likelihood. The likelihood (probability) is calculated corresponding to each position and the position at which the highest probability is calculated may be determined as a present position.

When the map is updated by the map generation unit 220 during travelling, the control unit 200 transmits the updated information to the air conditioner 700 through the communication unit such that the air conditioner is identical to the map stored in the robot cleaner 1.

When the cleaning command is input, the driving control unit 230 controls the driving unit to move to a specified area of the cleaning area and operates the cleaning unit to perform cleaning while travelling.

The driving control unit 230 moves an area to clean based on whether an area to be first cleaned is set or in specified order when the cleaning command is input with respect to a plurality of areas. When a separate order is not specified, the driving control unit 230 moves to a nearer area or an adjacent area depending on distances from the present position.

When the cleaning command is input regardless of an arbitrary area without distinguishing between areas, the driving control unit 230 moves to an area included in the arbitrary area and performs cleaning.

When the virtual wall is set, the driving control unit 230 determines the virtual wall and controls the driving unit, based on coordinate values inputs from the map generation unit 220.

Even if it is determined by the obstacle recognition unit 210 that there is absent an obstacle, the driving control unit 230 recognizes that the obstacle is present at the relevant position and controls the driving when the virtual wall is set.

When the setting of the virtual wall is changed during traveling, the driving control unit 230 distinguishes between an area in which driving is possible and an area in which driving is impossible, based on the changed setting of the virtual wall and set a traveling path again.

The driving control unit 230 controls the driving corresponding to any one of setting 1 for noise, setting 2 for a traveling path, setting 3 for avoidance, or setting 4 for security.

The driving control unit 230 may access the virtual wall to perform a specified operation (traveling path, setting 2), may clean after reducing noise caused by the main body (noise, setting 1), may travel while avoiding without accessing beyond a predetermined distance from the virtual wall (avoidance, setting 3), or may capture an image of a predetermined area based on the virtual wall (security, setting 4) based on the attribute of the virtual wall The control unit 200 stores a cleaning record in the data unit when the cleaning is completed with respect to the set specified area.

In addition, the control unit 200 may transmit the operating state or the cleaning state of the robot cleaner 1 to the air conditioner at a predetermined period through the communication unit 190.

The air conditioner displays the position of the robot cleaner together with the map, on a screen of an application, which is running, or output information on a cleaning state, based on data received from the robot cleaner 1.

When information on the obstacle is added, the air conditioner may update the map based on the received data.

The robot cleaner travels while distinguishing between an area in which driving is possible and an area in which driving is impossible based on the changed setting of the virtual wall when the cleaning command is input.

Meanwhile, the sensor unit 150 may include a camera. In addition, the control unit 200 may acquire an image obtained by photographing the indoor space by controlling the camera to photograph the indoor space.

Meanwhile, the sensor unit 150 may include at least one of a laser sensor, an ultrasonic sensor, an infrared sensor, or a camera. In addition, the sensor unit 150 may generate a map of an indoor space using at least one of an image captured through a laser, an ultrasonic wave, an infrared red light, or a camera.

In addition, the sensor unit 150 may include a temperature sensor to measure the temperature of the indoor space, a first heat sensor (for example, an infrared sensor) to sense the body temperature of the user, or a second heat sensor to sense the operating state of a gas stove or an electric stove or the heat radiation information on the heat radiated from an electronic product.

In addition, the sensor unit 150 may include a microphone to receive a sound.

Hereinafter, the first embodiment of the present disclosure will be described with reference to FIGS. 3 to 11. The first embodiment relates to a method for performing the optimal cooling depending on the type of the indoor space.

Figure 3:
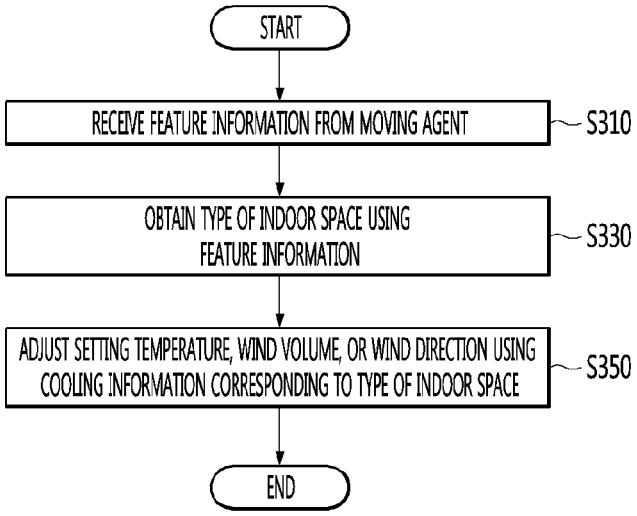
FIG. 3 is a view illustrating a method for operating the air conditioner according to a first embodiment of the present disclosure.

FIG. 3 is a view illustrating the method for operating the air conditioner, according to the first embodiment of the present disclosure.

The method for operating the air conditioner according to the embodiment of the present disclosure may include receiving feature information associated with the structure of the indoor space, which is collected by the moving agent (S310), obtaining the type of the indoor space using the received feature information (S330), and adjusting at least one of a setting temperature, a wind volume, or a wind direction of the air conditioner based on the cooling information corresponding to the type of the indoor space (S350).

Before the description of the present disclosure, problems caused due to the various structures of the indoor space will be described with reference to FIGS. 4A to 4D.

FIGS. 4A to 4D are views illustrating problems caused due to the various structures of the indoor space.

FIGS. 4A to 4D are plan views of a house. The indoor space to be described in the present disclosure may be the entire portion of a house including a living room and a bed room.

However, the present disclosure is not limited thereto. For example, the indoor space described in the present disclosure may refer to a space having an air conditioner installed therein and allowing the air discharged from the air conditioner to be provided directly and through convection current without being separated by a wall or a door.

For example, as illustrated in FIGS. 4A to 4D, when the air conditioner 700 is installed in a living room of a house, the indoor space according to the present disclosure may refer to a living room or a kitchen.

Figure 4A:
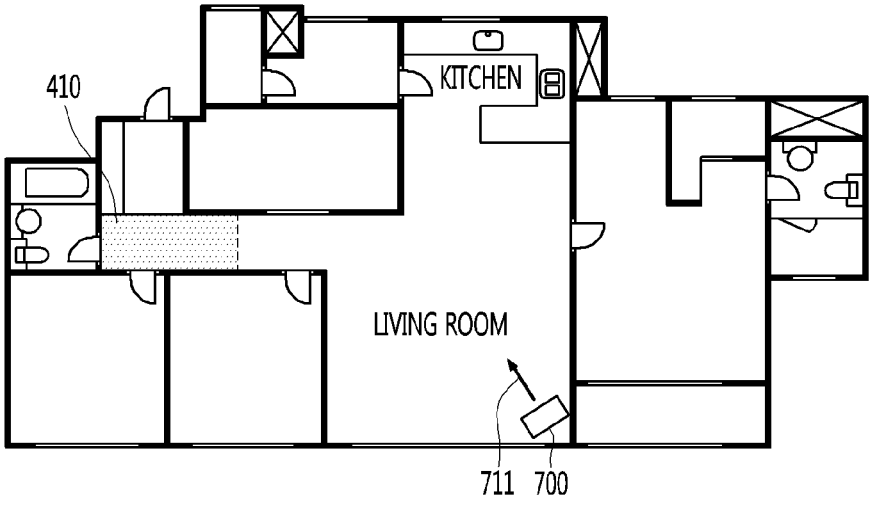
FIGS. 4A to 4D are views illustrating problems caused due to various structures of an indoor space.

As illustrated in FIG. 4A, the indoor space (the living room and the kitchen) has a left side in a corridor-type elongated shape.

In addition, when considering a typical position in which the air conditioner 700 is installed, a typical direction 711 (for example, a forward direction) in which the air discharged from the air conditioner 700 is directed, and the distance from the air conditioner 700, the air discharged from the air conditioner 700 fails to sufficiently reach an hatched area 410.

Figure 4B:
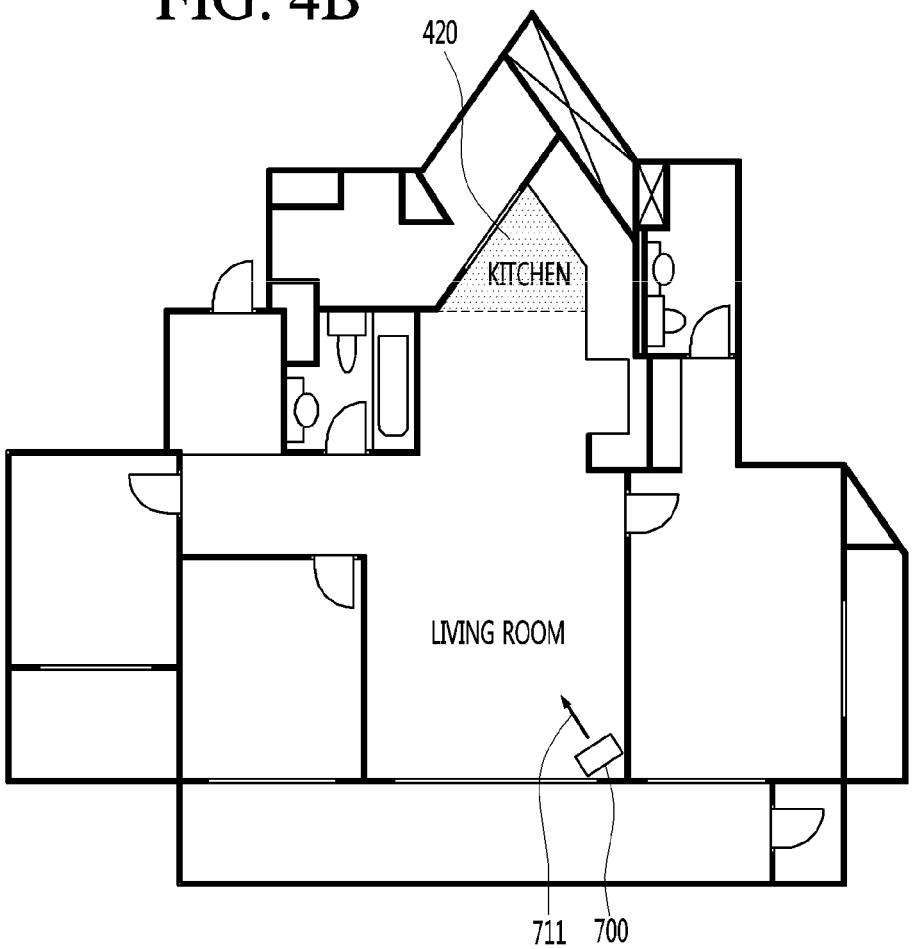

As illustrated in FIG. 4B, the indoor space protrudes up at the kitchen.

In addition, when considering a typical position in which the air conditioner 700 is installed, a typical direction 711 (for example, a forward direction) in which the air discharged from the air conditioner 700 is directed, and the distance from the air conditioner 700, the air discharged from the air conditioner 700 fails to sufficiently reach a hatched area 420 (kitchen).

As described above, an area in which the air discharged from the air conditioner 700 fails to sufficiently reach directly and through convection current due to the structure of the indoor space may be named a weak cooking zone. The weak cooling zone may be determined based on a real experiment or simulation in the relevant structure of the indoor space.

In addition, the weak cooling zone may have a higher temperature as compared to another area in the cooling operation of the air conditioner 700 since the air discharged from the air conditioner 700 fails to sufficiently reach the weak cooling zone.

Figure 4C:
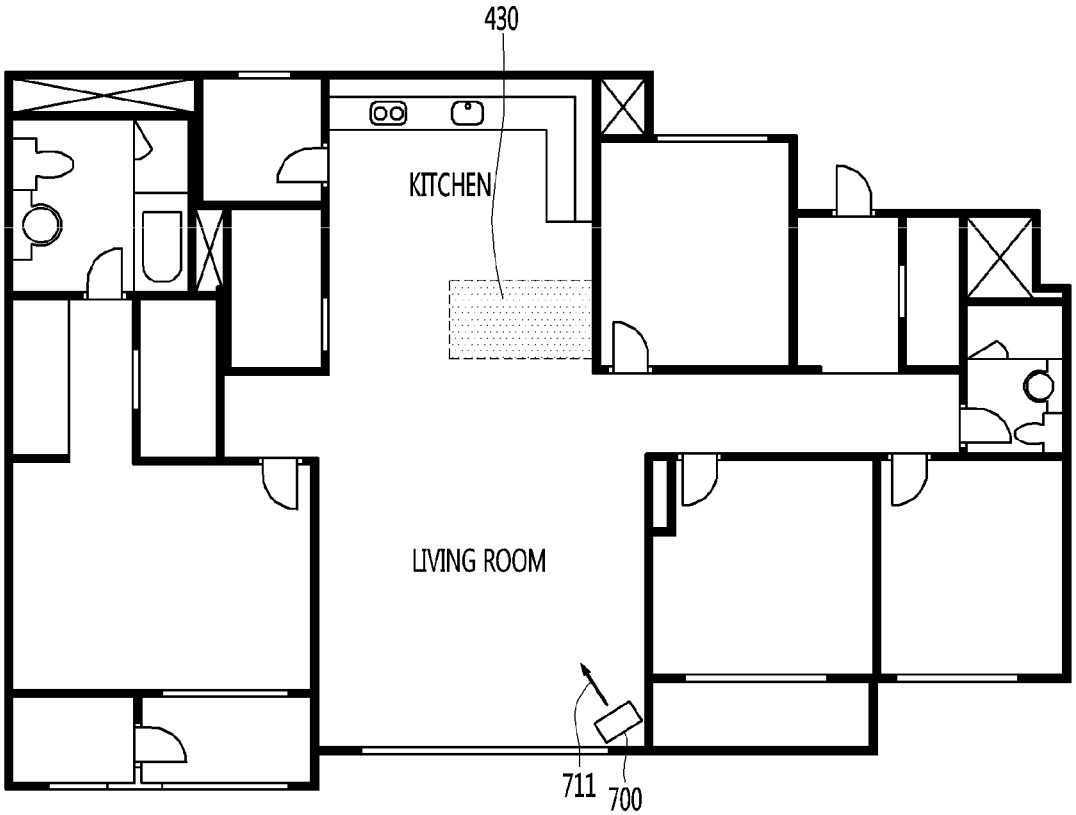

Meanwhile, a house of FIG. 4C has a wider indoor space than those of houses of FIGS. 4A and 4B.

In addition, since the hatched area 430 has a table allowing the family to seat together and eat hot foods together, the hatched area 430 requires excellent cooling.

An area in which the air discharged from the air conditioner 700 has to sufficiently reach directly and through convection current may be named a main cooling zone in the indoor space.

The main cooling zone may be determined based on position information of users in the structure of the relevant indoor space.

In addition, since the air discharged from the air conditioner 700 sufficiently reaches the main cooling zone, the main cooling zone has to have the lower temperature than that of another area in the cooling operation of the air conditioner 700.

However, since the house of FIG. 4C has the wider indoor space, the cooling of the main cooling zone may not be sufficiently performed.

Figure 4D:
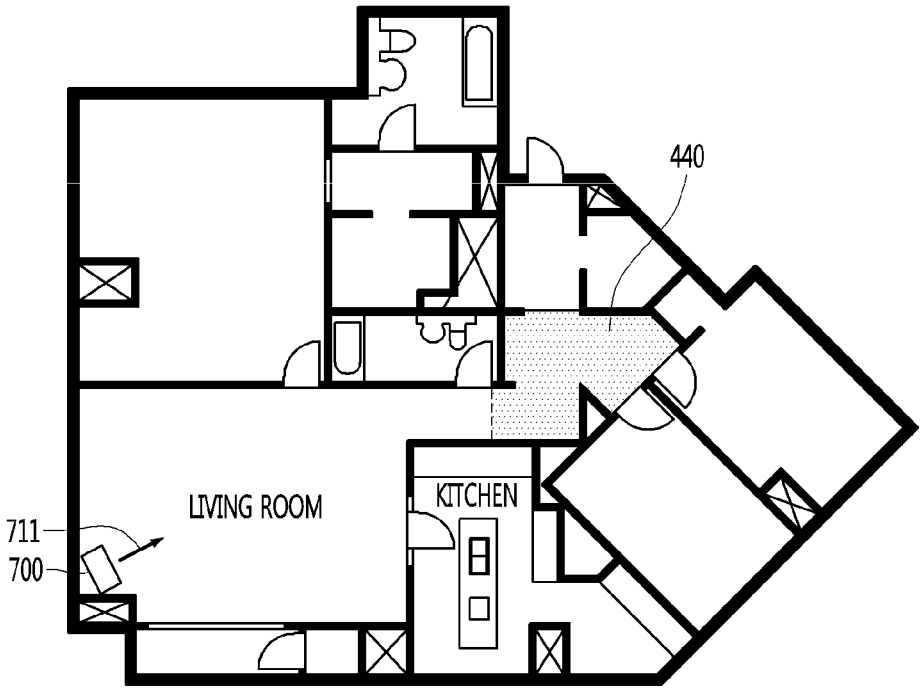

Meanwhile, in the house of FIG. 4D, the living room and the kitchen are separated from each other by a wall and a door, and the air conditioner 700 is installed in the living room. Accordingly, in the house of FIG. 4D, the indoor space may refer to a living room.

Meanwhile, the indoor space of the house of FIG. 4D has a winding structure on the right side thereof.

In addition, when considering a typical position in which the air conditioner 700 is installed, a typical direction 711 (for example, a forward direction) in which the air discharged from the air conditioner 700 is directed, and the distance from the air conditioner 700, the air discharged from the air conditioner 700 fails to sufficiently reach the hatched area 440.

Accordingly, as the hatched area 440 has the higher temperature, the average temperature of the whole indoor space is not excellently lowered.

Figure 5A:
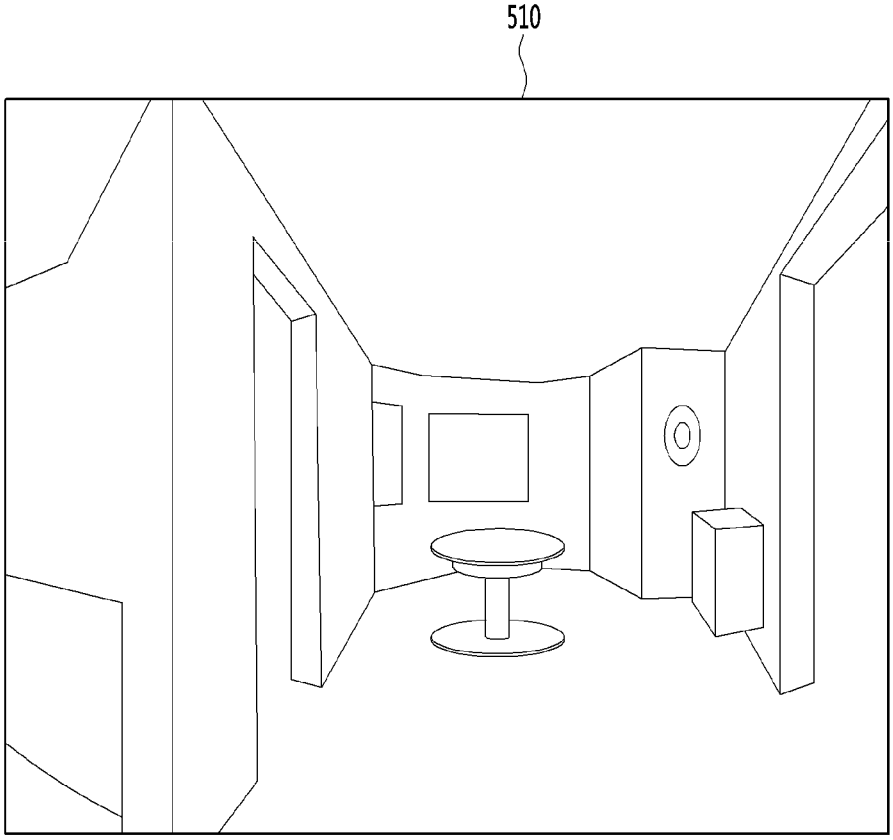
FIGS. 5A to 5C are views illustrating feature information according to an embodiment of the present disclosure.
Figure 5B:
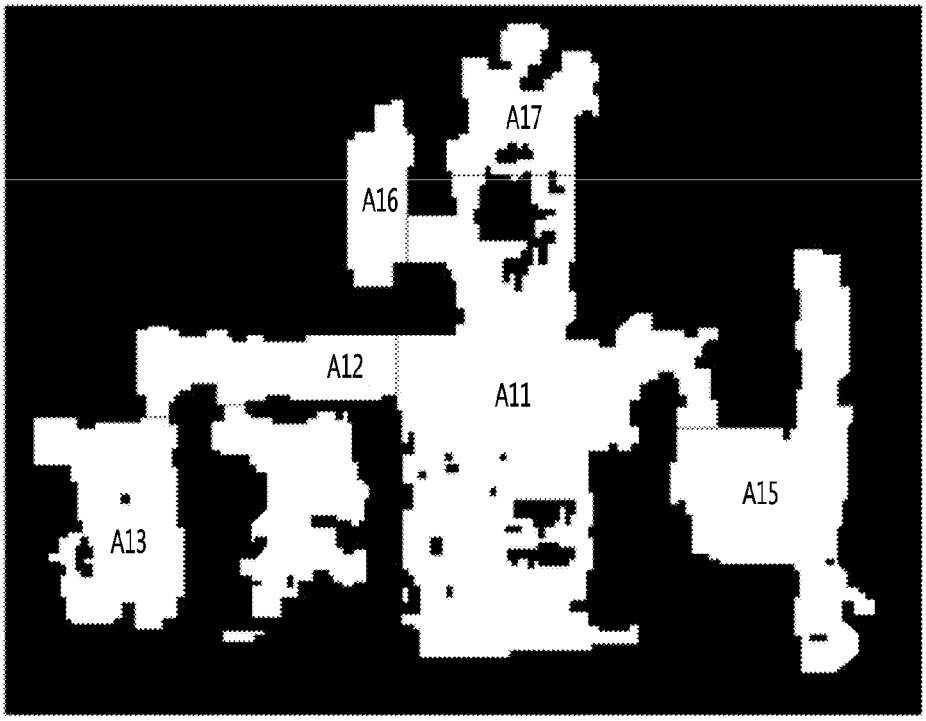
Figure 5C:
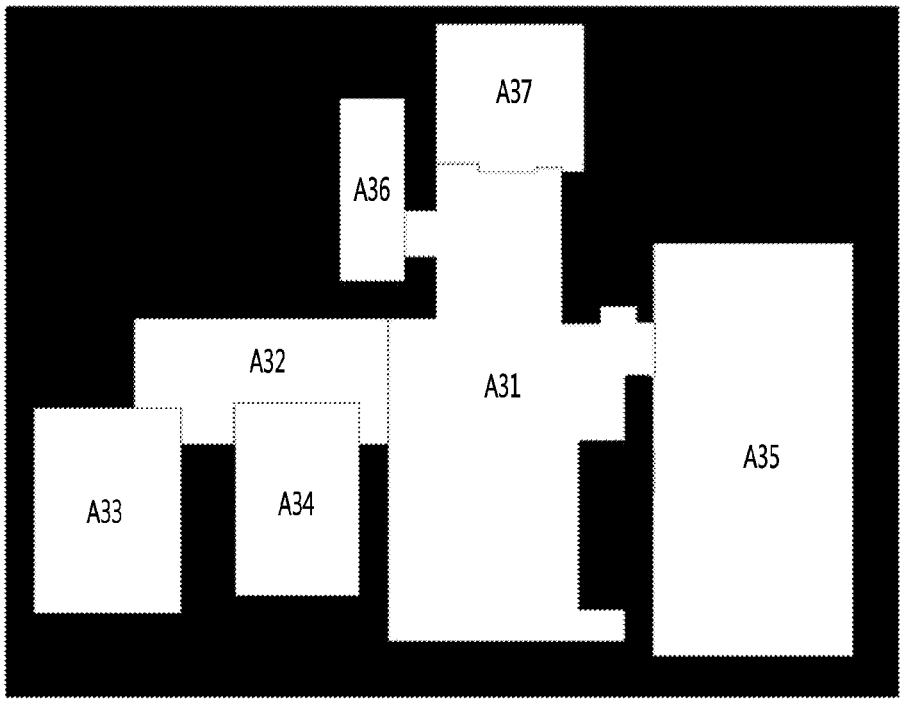

FIGS. 5A to 5C are views illustrating feature information according to an embodiment of the present disclosure.

The moving agent may collect information for generating a map of the indoor space while moving the indoor space.

For example, as illustrated in FIG. 5A, the moving agent may capture a plurality of images 510 by a camera while moving the indoor space. However, the image is provided by example of information for generating the map of the indoor space. For example, the moving agent may collect sensing information for generating a map of the indoor space using a radar, infrared rays, or ultrasonic waves.

Meanwhile, the moving agent may acquire an image of an air conditioner provided in the indoor space.

Meanwhile, the moving agent may generate a map of the indoor space by using the collected information.

For example, as illustrated in FIG. 5B, the moving agent may generate a map formed by a contour for the indoor space. In this case, the map may be divided into a plurality of zones A11 to A17, for example, a living room, room 1, or room 2.

Meanwhile, the moving agent may acquire an image obtained by photographing the air conditioner provided in the indoor space, and display the position and the direction of the air conditioner on the map based on the image obtained by capturing the air conditioner.

The map of the indoor space may include a processed map.

In detail, the moving agent may generate a processed map obtained by simplifying the structure of the indoor space by using the map of the indoor space such that the structure of the indoor space may be easily recognized.

In more detail, as illustrated in FIG. 5, the moving agent may arrange obstacles or make walls in the form of straight lines by simplifying the shape of the area.

Meanwhile, the moving agent may display the position and direction of the air conditioner on the processed map.

Meanwhile, the control unit 200 of the moving agent may transmit feature information associated with the structure of the indoor space to the air conditioner 700 through the communication unit 270. In this case, the feature information may include information collected through the sensor unit 150 to generate a map of the indoor space, a map generated by using the information collected through the sensor unit 150, or a map processed by simplifying the indoor space.

Meanwhile, the processor 780 of the air conditioner 700 may receive feature information associated with the structure of the indoor space obtained by the moving agent through the communication unit 710.

Meanwhile, when the information collected to generate a map of the indoor space is received as the feature information, the processor 780 of the air conditioner 700 may generate a map of the indoor space using the collected information to generate the map of the indoor space. In this case, the method for generating a map by the moving agent, which has been described above, will be used.

Figure 6:
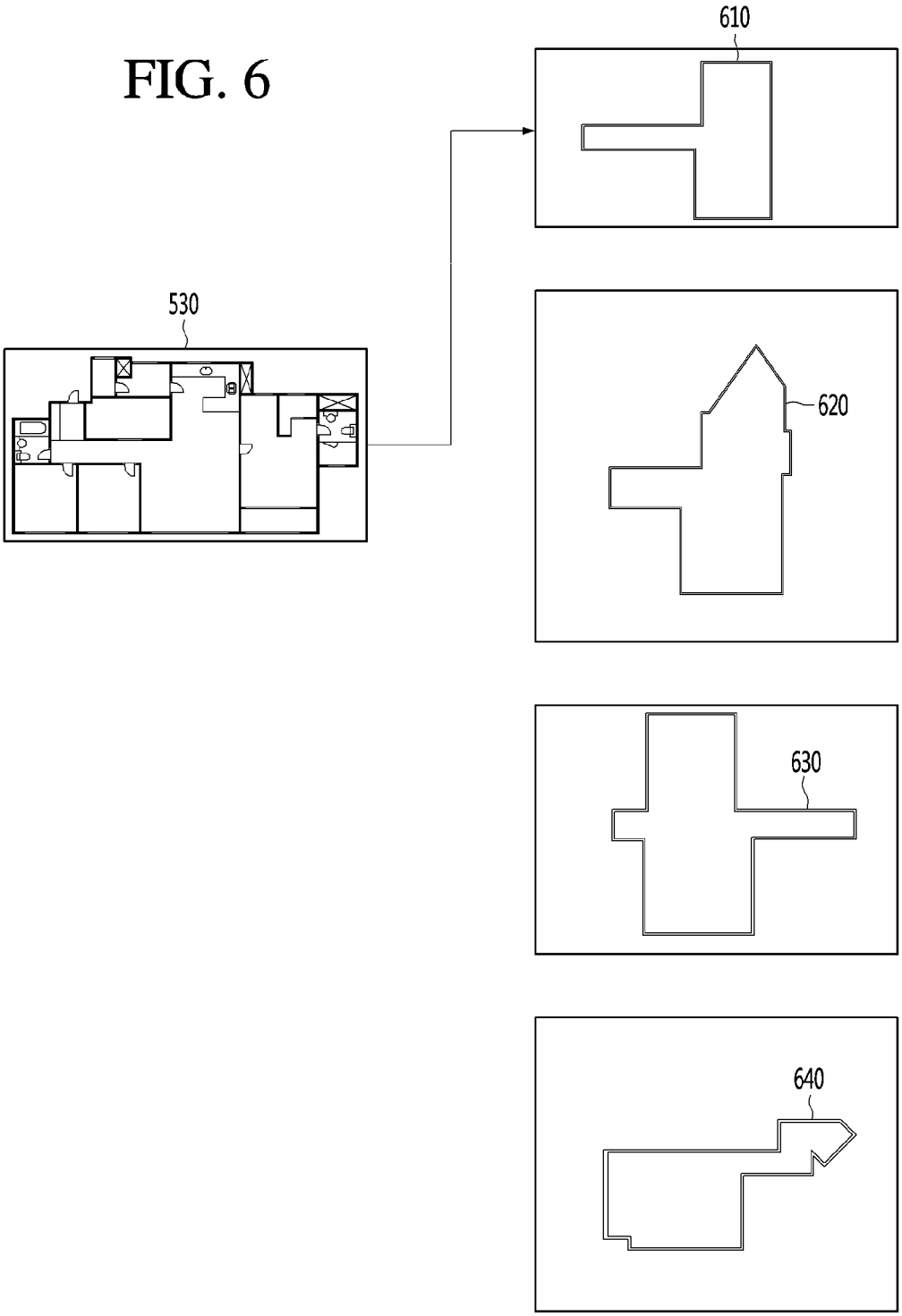
FIGS. 6, 7A and 7B are views illustrating a method for acquiring the type of an indoor space using feature information according to an embodiment of the present disclosure.

FIGS. 6 to 7 are views illustrating a method for acquiring the type of the indoor space using the feature information according to an embodiment of the present disclosure.

The processor 780 of the air conditioner 700 may acquire the type of the indoor space using the feature information.

In detail, referring to FIG. 6, a plurality of types 610, 620, 630, and 640 of indoor spaces may be stored in the memory of the air conditioner 700. In this case, the types 610, 620, 630, and 640 of indoor spaces may be different from each other in structure (area, boundary, or shape).

In addition, the processor 780 of the air conditioner 700 may compare the map of the indoor space 530 with the types 610, 620, 630, and 640 of the indoor spaces in structure (area, boundary, or shape) and may select the type 610 having the structure the most similar to the structure of the indoor space.

Meanwhile, when acquiring the type of the indoor space using the feature information, the processor 780 of the air conditioner 700 may acquire the type of the indoor space in consideration of the position and the direction of the air conditioner.

In more detail, the types 610, 620, 630, and 640 of the indoor spaces may be stored in the memory of the air conditioner 700. In this case, the types 610, 620, 630, and 640 of the indoor spaces may be different from each other in the structure (area, boundary, or shape) and the position and the direction of a virtual air conditioner provided in the types 610, 620, 630, and 640 of the indoor spaces.

In addition, the map of the indoor space may include information on the position and direction of the air conditioner.

In addition, the processor 780 of the air conditioner 700 may compare the structure (area, boundary, or shape), and the position and the direction of the air conditioner on the map of the indoor space 530 with the structures (areas, boundaries, or shapes), and the positions and the directions of virtual air conditioners of the types 610, 620, 630, and 640 of the indoor spaces and may select the type of the indoor space the most similar to the structure of the indoor space and the position and the direction of the air conditioner.

Meanwhile, the process of acquiring the type of indoor space may be performed through machine learning. The details thereof will be described with reference to FIGS. 7A and 7B.

Artificial intelligence (AI) is one field of computer engineering and information technology for studying a method of enabling a computer to perform thinking, learning, and self-development that can be performed by human intelligence and may denote that a computer imitates an intelligent action of a human.

Moreover, AI is directly/indirectly associated with the other field of computer engineering without being individually provided. Particularly, at present, in various fields of information technology, an attempt to introduce AI components and use the AI components in solving a problem of a corresponding field is being actively done.

Machine learning is one field of AI and is a research field which enables a computer to perform learning without an explicit program.

In detail, machine learning may be technology which studies and establishes a system for performing learning based on experiential data, performing prediction, and autonomously enhancing performance and algorithms relevant thereto. Algorithms of machine learning may use a method which establishes a specific model for obtaining prediction or decision on the basis of input data, rather than a method of executing program instructions which are strictly predefined.

The term "machine learning" may be referred to as "machine learning".

In machine learning, a number of machine learning algorithms for classifying data have been developed. Decision tree, Bayesian network, support vector machine (SVM), and artificial neural network (ANN) are representative examples of the machine learning algorithms.

The decision tree is an analysis method of performing classification and prediction by schematizing a decision rule into a tree structure.

The Bayesian network is a model where a probabilistic relationship (conditional independence) between a plurality of variables is expressed as a graph structure. The Bayesian network is suitable for data mining based on unsupervised learning.

The SVM is a model of supervised learning for pattern recognition and data analysis and is mainly used for classification and regression.

The ANN is a model which implements the operation principle of biological neuron and a connection relationship between neurons and is an information processing system where a plurality of neurons called nodes or processing elements are connected to one another in the form of a layer structure.

The ANN is a model used for machine learning and is a statistical learning algorithm inspired from a neural network (for example, brains in a central nervous system of animals) of biology in machine learning and cognitive science.

In detail, the ANN may denote all models where an artificial neuron (a node) of a network which is formed through a connection of synapses varies a connection strength of synapses through learning, thereby obtaining an ability to solve problems.

The term "ANN" may be referred to as "neural network".

The ANN may include a plurality of layers, and each of the plurality of layers may include a plurality of neurons. Also, the ANN may include a synapse connecting a neuron to another neuron.

The ANN may be generally defined by the following factors; (1) a connection pattern between neurons of a different layer; (2) a learning process of updating a weight of a connection; and (3) an activation function for generating an output value from a weighted sum of inputs received from a previous layer.

The ANN may include network models such as a deep neural network (DNN), a recurrent neural network (RNN), a bidirectional recurrent deep neural network (BRDNN), a multilayer perceptron (MLP), and a convolutional neural network (CNN), but is not limited thereto.

In this specification, the term "layer" may be referred to as "layer".

The ANN may be categorized into single layer neural networks and multilayer neural networks, based on the number of layers.

General single layer neural networks are configured with an input layer and an output layer.

Moreover, general multilayer neural networks are configured with an input layer, at least one hidden layer, and an output layer.

The input layer is a layer which receives external data, and the number of neurons of the input layer is the same the number of input variables, and the hidden layer is located between the input layer and the output layer and receives a signal from the input layer to extract a characteristic from the received signal and may transfer the extracted characteristic to the output layer. The output layer receives a signal from the hidden layer and outputs an output value based on the received signal. An input signal between neurons may be multiplied by each connection strength (weight), and values obtained through the multiplication may be summated. When the sum is greater than a threshold value of a neuron, the neuron may be activated and may output an output value obtained through an activation function.

The DNN including a plurality of hidden layers between an input layer and an output layer may be a representative ANN which implements deep learning which is a kind of machine learning technology.

The term "deep learning" may be referred to as "deep learning".

The ANN may be trained by using training data. Here, training may denote a process of determining a parameter of the ANN, for achieving purposes such as classifying, regressing, or clustering input data. A representative example of a parameter of the ANN may include a weight assigned to a synapse or a bias applied to a neuron.

An ANN trained based on training data may classify or cluster input data, based on a pattern of the input data.

In this specification, an ANN trained based on training data may be referred to as a trained model.

Next, a learning method of an ANN will be described.

The learning method of the ANN may be largely classified into supervised learning, unsupervised learning, semi-supervised learning, and reinforcement learning.

The supervised learning may be a method of machine learning for analogizing one function from training data.

Moreover, in analogized functions, a function of outputting continual values may be referred to as regression, and a function of predicting and outputting a class of an input vector may be referred to as classification.

In the supervised learning, an ANN may be trained in a state where a label of training data is assigned.

Here, the label may denote a right answer (or a result value) to be inferred by an ANN when training data is input to the ANN.

In this specification, a right answer (or a result value) to be inferred by an ANN when training data is input to the ANN may be referred to as a label or labeling data.

Moreover, in this specification, a process of assigning a label to training data for learning of an ANN may be referred to as a process which labels labeling data to training data.

In this case, training data and a label corresponding to the training data may configure one training set and may be inputted to an ANN in the form of training sets.

Training data may represent a plurality of features, and a label being labeled to training data may denote that the label is assigned to a feature represented by the training data. In this case, the training data may represent a feature of an input object as a vector type.

An ANN may analogize a function corresponding to an association relationship between training data and labeling data by using the training data and the labeling data. Also, a parameter of the ANN may be determined (optimized) through evaluating the analogized function.

The unsupervised learning is a kind of machine learning, and in this case, a label may not be assigned to training data.

In detail, the unsupervised learning may be a learning method of training an ANN so as to detect a pattern from training data itself and classify the training data, rather than to detect an association relationship between the training data and a label corresponding to the training data.

Examples of the unsupervised learning may include clustering and independent component analysis.

In this specification, the term "clustering" may be referred to as "clustering".

Examples of an ANN using the unsupervised learning may include a generative adversarial network (GAN) and an autoencoder (AE).

The GAN is a method of improving performance through competition between two different AIs called a generator and a discriminator.

In this case, the generator is a model for creating new data and generates new data, based on original data.

Moreover, the discriminator is a model for recognizing a pattern of data and determines whether inputted data is original data or fake data generated from the generator.

Moreover, the generator may be trained by receiving and using data which does not deceive the discriminator, and the discriminator may be trained by receiving and using deceived data generated by the generator. Therefore, the generator may evolve so as to deceive the discriminator as much as possible, and the discriminator may evolve so as to distinguish original data from data generated by the generator.

The AE is a neural network for reproducing an input as an output.

The AE may include an input layer, at least one hidden layer, and an output layer.

In this case, the number of node of the hidden layer may be smaller than the number of nodes of the input layer, and thus, a dimension of data may be reduced, whereby compression or encoding may be performed.

Moreover, data outputted from the hidden layer may enter the output layer. In this case, the number of nodes of the output layer may be larger than the number of nodes of the hidden layer, and thus, a dimension of the data may increase, and thus, decompression or decoding may be performed.

The AE may control the connection strength of a neuron through learning, and thus, input data may be expressed as hidden layer data. In the hidden layer, information may be expressed by using a smaller number of neurons than those of the input layer, and input data being reproduced as an output may denote that the hidden layer detects and expresses a hidden pattern from the input data.

The semi-supervised learning is a kind of machine learning and may denote a learning method which uses both training data with a label assigned thereto and training data with no label assigned thereto.

As a type of semi-supervised learning technique, there is a technique which infers a label of training data with no label assigned thereto and performs learning by using the inferred label, and such a technique may be usefully used for a case where the cost expended in labeling is large.

The reinforcement learning may be a theory where, when an environment where an agent is capable of determining an action to take at every moment is provided, the best way is obtained through experience without data.

The reinforcement learning may be performed by a Markov decision process (MDP).

To describe the MDP, firstly an environment where pieces of information needed for taking a next action of an agent may be provided, secondly an action which is to be taken by the agent in the environment may be defined, thirdly a reward provided based on a good action of the agent and a penalty provided based on a poor action of the agent may be defined, and fourthly an optimal policy may be derived through experience which is repeated until a future reward reaches a highest score.

The artificial neural network may be specified, in the structure thereof, through the configuration of a model, an activation function, a loss function, a cost function, a learning algorithm, or an optimal algorithm. The Hyperparameter is previously set before leaning and the model parameter is set through the learning thereafter, so the content thereof may be specified.

For example, the element to determine the structure of the artificial neural network may include the number of hidden nodes, the number of hidden nodes included in each hidden layer, an input feature vector, or a target feature vector.

The Hyperparameer includes several parameters that have to be set at the initial stage for learning, like an initial value of the model parameter. In addition, the model parameter includes several parameters to be determined through learning.

The Hyperparameer may include a weight initial value between nodes, a deflection initial value between nodes, a mini-batch size, a repeated learning count, or a learning rate. In addition, the model parameter may include an inter-node weight or an inter-node deflection.

The loss function can be used for an index (reference) for determining optimum model parameters in a training process of an artificial neural network. In an artificial neural network, training means a process of adjusting model parameters to reduce the loss function and the object of training can be considered as determining model parameters that minimize the loss function.

The loss function may employ a mean squared error (MSE) or a cross entropy error (CEE), and the present disclosure is not limited thereto.

The CEE may be used when a correct answer label is one-hot encoded. One-hot encoding is an encoding method for setting a correct answer label value to 1 for only neurons corresponding to a correct answer and setting a correct answer label to 0 for neurons corresponding to a wrong answer.

A learning optimization algorithm may be used to minimize a loss function in machine learning or deep learning, as the learning optimization algorithm, there are Gradient Descent (GD), Stochastic Gradient Descent (SGD), Momentum, NAG (Nesterov Accelerate Gradient), Adagrad, AdaDelta, RMSProp, Adam, and Nadam.

The GD is a technique that adjusts model parameters such that a loss function value decreases in consideration of the gradient of a loss function in the current state.

The direction of adjusting model parameters is referred to as a step direction and the size of adjustment is referred to as a step size.

In this case, the step size may refer to a learning rate.

According to the GD, the partial derivative of the loss function with each model parameter may be performed and an inclination is obtained, and the model parameter may be updated as the model parameters are changed at the learning rate along the obtained inclination.

The SGD is a technique that increases the frequency of gradient descent by dividing training data into mini-batches and performing the GD for each of the mini-batches.

The Adagrad, AdaDelta, and RMSProp in the SGD are techniques that increase optimization accuracy by adjusting the step size. The momentum and the NAG in the SGD are techniques that increase optimization accuracy by adjusting the step direction. The Adam is a technique that increases optimization accuracy by adjusting the step size and the step direction by combining the momentum and the RMSProp. The Nadam is a technique that increases optimization accuracy by adjusting the step size and the step direction by combining the NAG and the RMSProp.

The learning speed and accuracy of an artificial neural network greatly depends on not only the structure of the artificial neural network and the kind of a learning optimization algorithm, but the hyperparameters. Accordingly, in order to acquire a good trained model, it is important not only to determine a suitable structure of an artificial neural network, but also to set suitable hyperparameters.

In general, hyperparameters are experimentally set to various values to train an artificial neural network, and are set to optimum values that provide stable learning speed and accuracy using training results.

Meanwhile, the training of the ANN may be performed by a separate training device as well as the air conditioner 700.

In this case, the training device may determine the optimized model parameters of the artificial neural network 650 by repeatedly training the artificial neural network 650 using the various learning techniques described above.

In the disclosure, an artificial neural network, parameters of which are determined by being trained using training data may be referred to as a learning model or a trained model.

In this case, the learning model may infer a result value in the state of being mounted in the training device of the artificial neural network, or may be mounted in the air conditioner 700.

Meanwhile, the artificial neural network 650 may be implemented in hardware, software, or the combination of hardware and software. When a portion or an entire portion of the artificial neural network 650 is implemented in software, at least one command constituting the artificial neural network 650 may be stored in the memory 770 of the air conditioner 700.

In addition, when the learning model is updated, the updated learning model may be transmitted to and mounted on the air conditioner 700.

Hereinafter, a method for training the neural network based on supervised learning will be described.

In the present disclosure, a map generated using sensing information collected by a moving agent may be used as the training data, and the type of the indoor space may be input as a label to the neural network together with the map.

In detail, the training device may train the neural network using a map generated by using the sensing information collected by the moving agent and the type of the indoor space corresponding to the map.

For example, it is assumed that an A map is generated by using sensing information collected in an indoor space in type A having a specific structure. In this case, the training device may train the neural network using the A map and the A type labeled on the A map.

In such a manner, various maps and types of indoor space may be input as the training data into the neural network.

In this case, the training device may repeatedly train the neural network using supervised learning.

In this case, the neural network may infer a function of the correlation between the map and the type of indoor space corresponding to the map. In addition, the neural network may determine (optimize) the parameters of the neural network by evaluating the inferred function.

Accordingly, the trained neural network may classify new input data (map) based on the types when the new input data (map) is received.

Hereinafter, a method for training the neural network based on unsupervised learning will be described.

The unsupervised learning may be a learning method for training an artificial neural network to find and classify patterns in the training data itself. In addition, clustering may refer to a process of clustering feature vectors obtained from the artificial neural network into finite clusters.

The training device may train the artificial neural network such that maps having similar structures form one cluster using various maps as training data.

There may present a plurality of clusters, and one cluster may represent a specific type of an indoor space. For example, the first cluster may correspond to an indoor space in the type A and the second cluster may correspond to an indoor space in the type B.

Accordingly, the trained neural network may cluster new input data (map) based on the types when the new input data (map) is received.

In addition, the map used as the training data may include information on the position and direction of the air conditioner.

An artificial neural network, parameters of which are determined by being trained using training data may be referred to as a learning model or a trained model.

In addition, the learning model described herein may refer to a neural network trained using feature information acquired from the moving agent.

The learning model may be installed in the air conditioner 700.

Meanwhile, the learning model may be implemented in hardware, software, or the combination of hardware and software. When a portion or an entire portion of the learning model is implemented in software, at least one command constituting the learning model may be stored in the memory 770 of the air conditioner 700.

Meanwhile, the processor 780 of the air conditioner 700 may acquire the type of the indoor space using the feature information.

In detail, the processor 780 may input a map generated using the sensing information collected by the moving agent, into the learning model.

In addition, as the learning model having the feature information received therein outputs (classifies or clusters) the type of the indoor space, the type of the indoor space in which the moving agent and the air conditioner are positioned may be obtained.

Figure 7A:
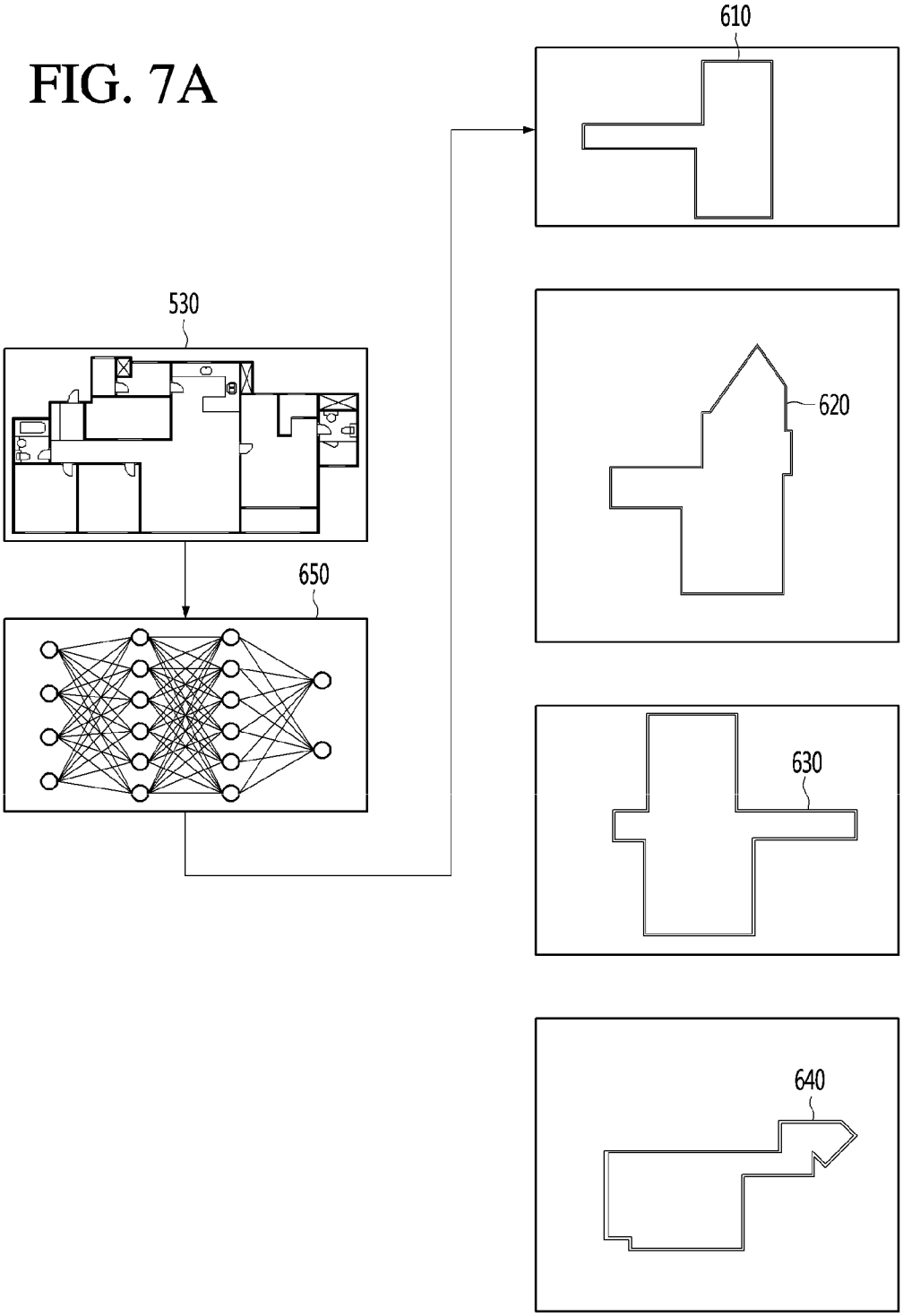
Figure 7B:
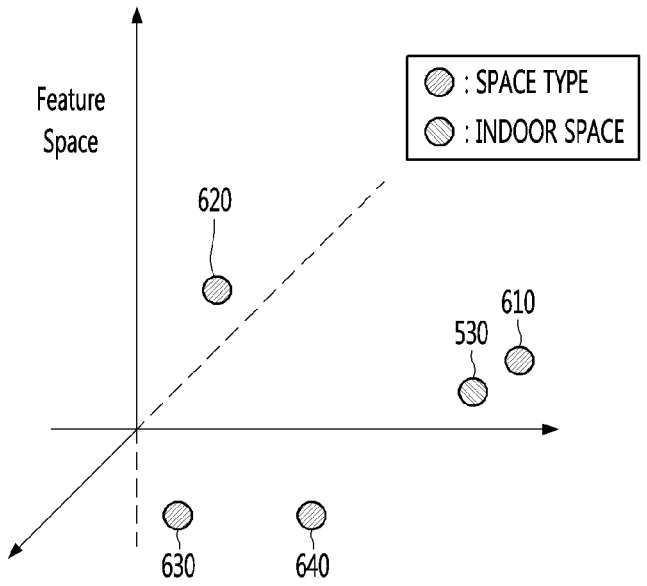

For example, as illustrated in FIGS. 7A and 7B, the learning model 650 receives a map of the indoor space 530, and may cluster the map of the indoor space 530 in the type 610 at the distance closest to the structure of the indoor space 530.

Meanwhile, the method for determining the type of the indoor space described with reference to FIGS. 6 to 7 may be performed by the server.

In more detail, the processor of the air conditioner 700 may communicate with a server through a communication unit.

The processor of the air conditioner may receive feature information from the server.

In this case, the server may acquire the type of the indoor space by using the feature information. In this case, the manner in which the air conditioner acquires the type of the indoor space may be applied to the server.

For example, the server may include a memory in which the types of the indoor spaces are stored.

In addition, the processor of the server may compare the structure of the indoor space on the map with the structures of a plurality of types of indoor spaces to select a type having a structure most similar to that of the indoor space.

For another example, a learning model may be mounted in the server. The processor of the server may acquire the type of the indoor space by inputting the feature information into the learning model.

Meanwhile, when the type of the indoor space is acquired, the server may transmit the type of the indoor space to the air conditioner 700.

Meanwhile, a plurality of cooling information corresponding to the types of the plurality of indoor spaces may be stored in the memory of the air conditioner 700.

The processor of the air conditioner 700 may control the cooling by using the cooling information corresponding to the type of the indoor space among the plurality of cooling information corresponding to the types of the indoor spaces.

The cooling information may be a setting value of the air conditioner, which allows the internal temperature of the indoor space to rapidly reach the target temperature, corresponding to the structure of the indoor space.

In detail, the air discharged from the air conditioner is circulated in the indoor space, and the method of circulating the indoor space is varied depending on the structures of the indoor space. Therefore, the best setting value of the air conditioner for cooling an indoor space may be varied depending on the structures of the indoor spaces.

Multiple pieces of cooling information corresponding to a plurality of types of indoor spaces may be setting values of the air conditioner for allowing the optimal cooling in the relevant type of the indoor space.

Table 1 illustrates an example of cooling information, that is, the setting value of the air conditioner.

TABLE 1

| | Wind volume | Wind Direction | Setting Temperature |
|---|---|---|---|
| Type A | Maximum | Up and down: 120° C.<br>Left and right: 150° C. | 24° C. |
| Type B | High | Up and down: 90° C.<br>Left and right: 105° C. | 26 |
| Type C | Middle | Up and down: 80° C.<br>Left and right: 70° C. | 25° C. |
| Type D | Small | Up and down: 110° C.<br>Left and right: 90° C. | 27° C. |

MODE FOR INVENTION

In other words, the cooling information may include at least one of a wind volume, a wind direction, or a setting temperature of the air conditioner.

It has been described that the setting temperature of the air conditioner is a specific value in table 1. However, the present disclosure is not limited thereto, and the setting temperature of the air conditioner may be represented by the difference from a target temperature.

For example, the setting temperature included in the cooling information may be 2° C. lower than the target temperature. In this case, when the user sets the target temperature to 26° C., the setting temperature of air discharged from the air conditioner may be 24° C.

Meanwhile, the cooling information corresponding to the indoor space may be determined in advance and stored in the memory.

For example, the optimal setting value of the air conditioner in the type A may be determined through a real experiment, a simulation, a reinforcement learning-based neural network, or a recurrent neural network (RNN) algorithm. In addition, the optimal setting value of the air conditioner in the type A may be stored as cooling information corresponding to the type A in the memory.

Meanwhile, the cooling information may be set to accomplish various purposes. This will be described with reference to FIGS. 8 to 10B.

FIGS. 8 to 10B are views illustrating cooling information for various purposes.

Figure 8:
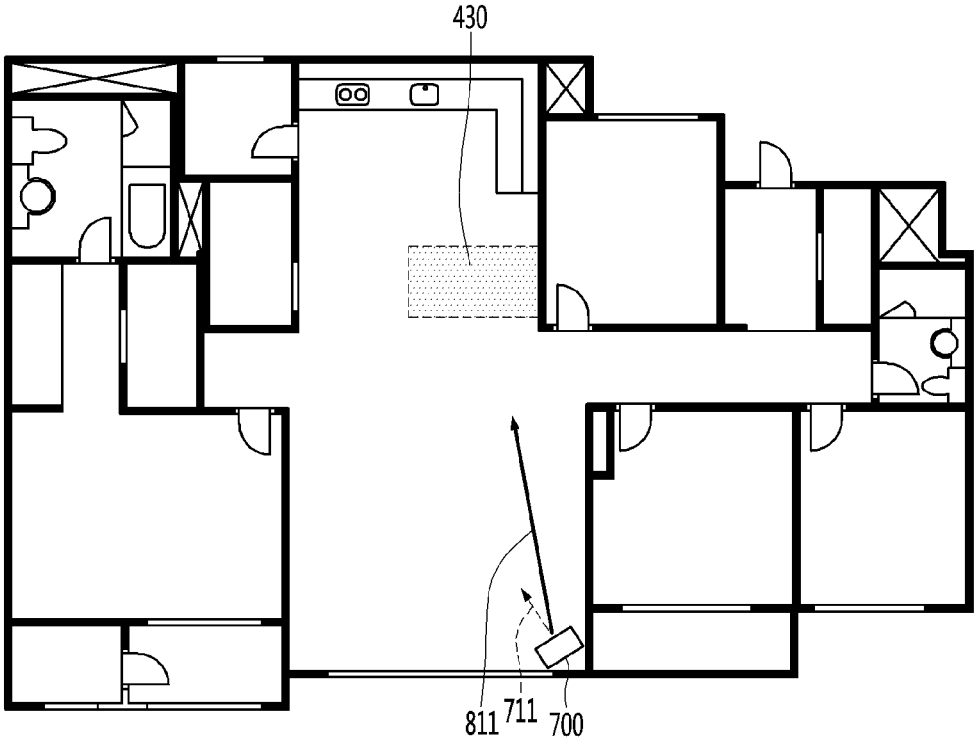
FIGS. 8 to 10B are views illustrating cooling information for various purposes.

Referring to FIG. 8, the cooling information may be a setting value of the air conditioner to more rapidly lower a temperature of a main cooling zone in the indoor space than a temperature of another zone in the indoor space, corresponding to the structure of the indoor space.

In detail, since the hatched area 430 has a table allowing the family to seat together and eat hot foods together, the hatched area 430 requires excellent cooling. This area may be named a main cooling zone.

In addition, the cooling information may be a setting value of the air conditioner for more rapidly lowering the temperature of the main cooling zone than the temperature of another zone, as the air discharged from the air conditioner 700 more sufficiently reaches the main cooling zone directly or through convection current as compared to another zone.

In addition, when the air conditioner 700 operates based on the cooling information (for example, discharges air in a wind volume and a wind direction as in an arrow 811), the temperature of the main cooling zone may be lower than the temperature of the main cooling zone when the air conditioner 700 operates regardless of the cooling information (for example, discharges air in a wind volume and a wind direction as in arrow 711).

Meanwhile, the processor 780 of the air conditioner 700 may adjust at least one of a setting temperature, a wind volume, or a wind direction by using the type of the indoor space.

In detail, the processor 780 may adjust at least one of a setting temperature, a wind volume, or a wind direction of the air conditioner, based on cooling information (the setting value of the air conditioner), which corresponds to the type of the indoor space, of multiple pieces of cooling information.

In addition, the processor 780 may control at least one of operations of the compressor, the fan motor, or the vane motor using the type of the indoor space to adjust at least one of a setting temperature, a wind volume, or a wind direction of the air conditioner.

For example, the processor 780 may control the operation of the compressor 740 based on the setting temperature of the cooling information. As the operation of the compressor 740 is controlled, the setting temperature of the air conditioner 780 may be adjusted. In this case, the adjusted setting temperature may be the same as the setting temperature included in the cooling information.

In addition, the processor 780 may control the operation of the fan motor 750 based on the wind volume of the cooling information. As the operation of the fan motor 750 is controlled, the wind volume of the air conditioner 780 may be adjusted. In this case, the adjusted wind volume may be the same as information on a wind volume included in the cooling information.

In addition, the processor 780 may control the operation of the vane motor based on the wind direction of the cooling information. As the operation of the vane motor is controlled, the wind direction of the air conditioner 780 may be adjusted. In this case, the adjusted wind direction may be the same as information on a wind direction included in the cooling information.

Figure 9:
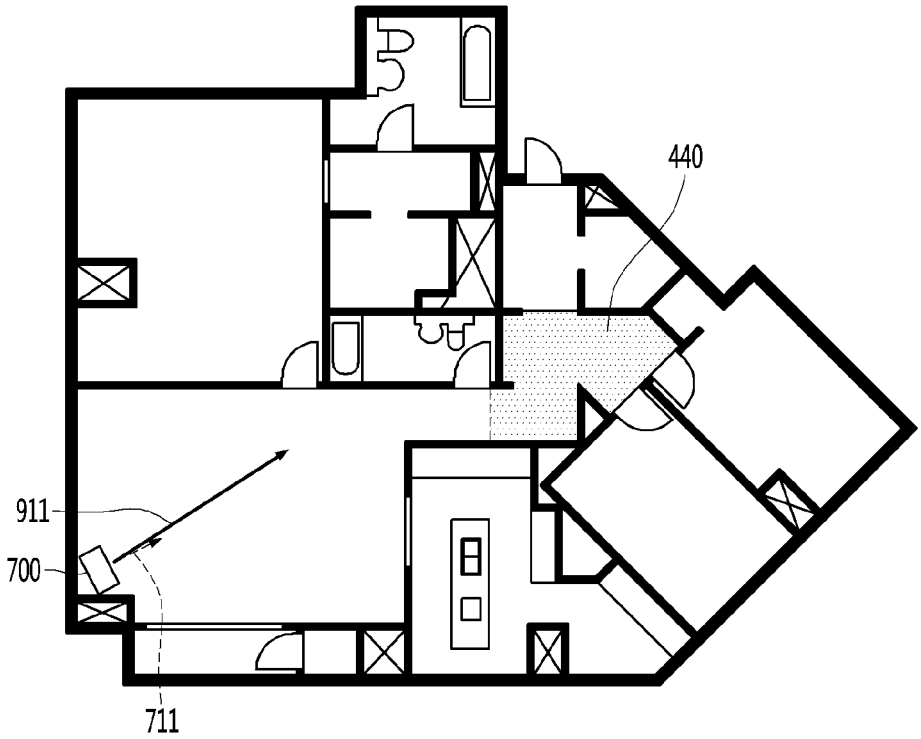

Meanwhile, referring to FIG. 9, the cooling information is a setting value of the air conditioner to allow an average temperature of the indoor space to rapidly reach a target temperature, corresponding to the structure of the indoor space.

In detail, when considering a typical position in which the air conditioner 700 is installed, a typical direction 711 (for example, a forward direction) in which the air discharged from the air conditioner 700 is directed, and the distance from the air conditioner 700, the air discharged from the air conditioner 700 fails to sufficiently reach the hatched area 440.

Accordingly, as the hatched area 440 has the higher temperature, the average temperature of the whole indoor space is not sufficiently lowered.

Therefore, the cooling information may be setting information of the air conditioner to most rapidly lower an average temperature of the whole indoor space, as the air discharged from the air conditioner 700 is circulated.

For example, when the air conditioner 700 operates based on the cooling information (for example, discharges air in a wind volume and a wind direction as in an arrow 911), the temperature of the indoor space may be lower than the temperature of the indoor space when the air conditioner 700 operates regardless of the cooling information (for example, discharges air in a wind volume and a wind direction as in arrow 711).

Meanwhile, the cooling information may be a setting value of the air conditioner to reduce the difference between the temperature of the weak cooling zone in the indoor space and the temperature of another zone in the indoor space, corresponding to the structure of the indoor space.

Figure 10A:
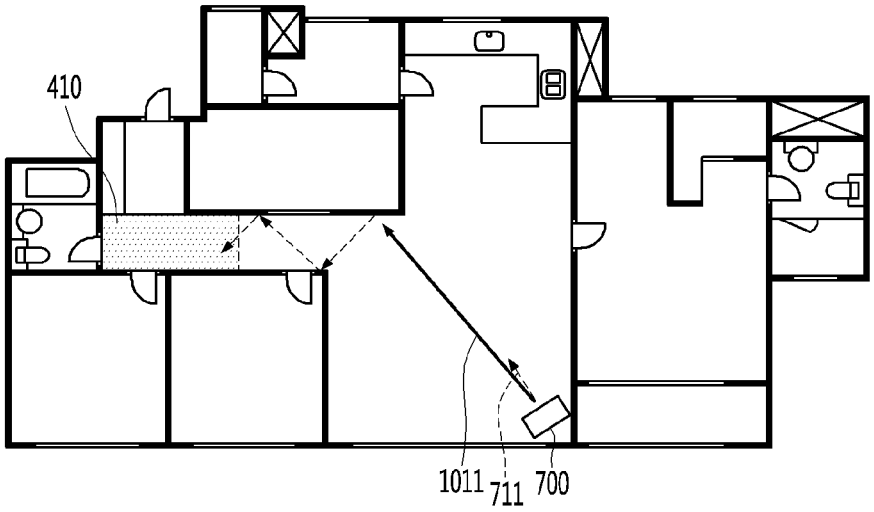

As illustrated in FIG. 10A, the indoor space (the living room and the kitchen) has a left side in a corridor-type elongated shape.

In addition, when considering a typical position in which the air conditioner 700 is installed, a typical direction 711 (for example, a forward direction) in which the air discharged from the air conditioner 700 is directed, and the distance from the air conditioner 700, the air discharged from the air conditioner 700 fails to sufficiently reach the hatched area 410.

Figure 10B:
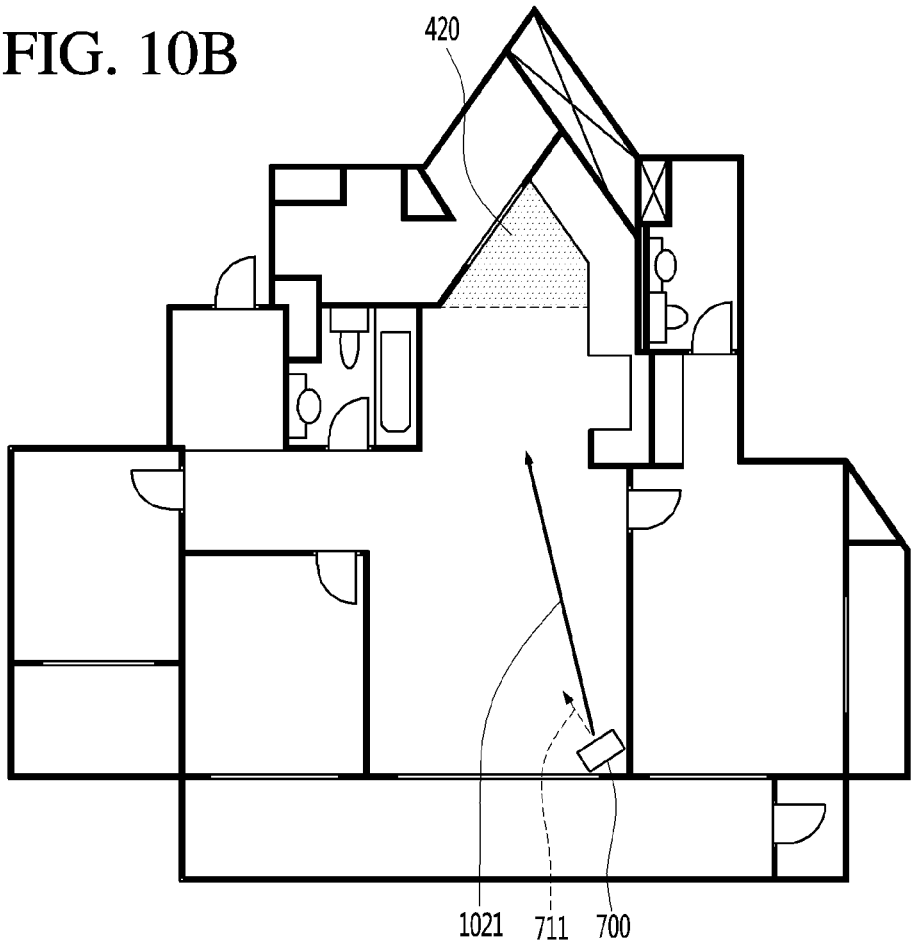

As illustrated in FIG. 10B, the indoor space protrudes up at the kitchen.

In addition, when considering a typical position in which the air conditioner 700 is installed, a typical direction 711 (for example, a forward direction) in which the air discharged from the air conditioner 700 is directed, and the distance from the air conditioner 700, the air discharged from the air conditioner 700 fails to sufficiently reach a hatched area 420 (kitchen).

As described above, an area, in which the air discharged from the air conditioner 700 fails to sufficiently reach directly and through convection current due to the structure of the indoor space, may be named a weak cooking zone.

In addition, the weak cooling zone may have a higher temperature as compared to another area in the cooling operation of the air conditioner 700 since the air discharged from the air conditioner 700 fails to sufficiently reach the weak cooling zone.

In addition, the cooling information may be a setting value of the air conditioner for more rapidly lowering the temperature of the weak cooling zone than the temperature of another zone, as the air discharged from the air conditioner 700 more sufficiently reaches the weak cooling zone directly or through convection current as compared to another zone.

In addition, when the air conditioner 700 operates based on the cooling information (for example, discharges air in a wind volume and a wind direction as in an arrow 1011 or 1021), the temperature difference between the weak cooling zone 410 or 420 and another area may be less than the temperature difference between the weak cooling zone 410 or 420 and the another area when the air conditioner 700 operates regardless of the cooling information (for example, discharges air in a wind volume and a wind direction as in arrow 711).

Meanwhile, as described above, the air in the indoor space may not be uniformly cooled due to the structure of the indoor space and the position of the air conditioner.

In addition, the cooling information may be a setting value of the air conditioner to uniformly make a temperature of air in the whole indoor space, as the air discharged from the air conditioner 700 uniformly reaches a plurality of zones in the indoor space directly or through convection current.

Accordingly, when the air conditioner 700 operates based on the cooling information, the temperature difference between the plurality of zones in the indoor space may be less than the temperature difference between the plurality of zones in the indoor space when the air conditioner 700 operates regardless of the cooling information.

Meanwhile, the cooling information may be provided by the server.

In more detail, the processor 780 of the air conditioner 700 may transmit the type of the indoor space to the server.

Meanwhile, the memory included in the server may store multiple pieces of cooling information corresponding to the types of a plurality of indoor spaces.

When the server acquires the type of the indoor space using the feature information, or when the server receives the type of the indoor space from the air conditioner 700, the server may transmit, to the air conditioner 700, cooling information corresponding to the type of the indoor space.

Figure 11:
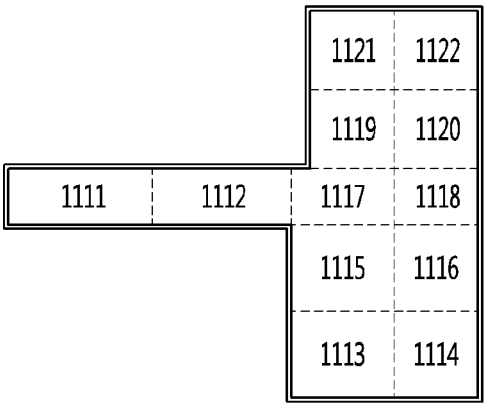
FIG. 11 is a view illustrating multiple pieces of cooling information corresponding to a plurality of zones included in an indoor space.
Figure 11:
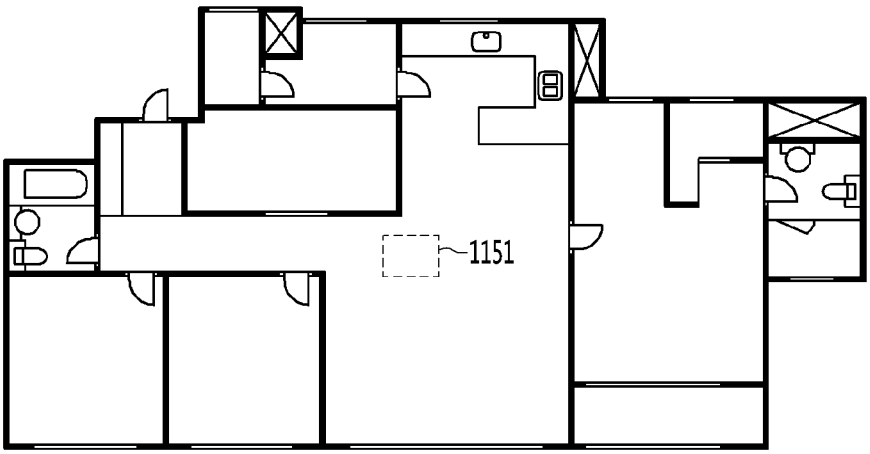

Meanwhile, FIG. 11 is a view illustrating multiple pieces of cooling information corresponding to the plurality of zones included in the indoor space.

Referring to FIG. 11A, the cooling information corresponding to the indoor space in a specific type may include multiple pieces of cooling information corresponding to a plurality of zones 1111, 1112, 1113, 1114, 1115, 1116, 1117, 1118, 1119, 1120, 1121, and 1122 included in the indoor space in the specific type, respectively. In this case, the multiple pieces of cooling information corresponding to the plurality of zones may be used together with multiple pieces of zone cooling information corresponding to the plurality of zones.

In this case, the multiple pieces of cooling information may be setting values to rapidly lower the temperature of a relevant zone in the indoor space, corresponding to the structure of the indoor space.

In detail, the best setting value of the air conditioner for cooling the indoor space may be varied depending on zones.

Accordingly, the multiple pieces of cooling information corresponding to the plurality of zones 1111, 1112, 1113, 1114, 1115, 1116, 1117, 1118, 1119, 1120, 1121, and 1122 included in the indoor space, respectively, may be setting values of the air conditioner for performing the optimal cooling in the respect zones.

For example, the cooling information in the type A may include first to twelfth cooling information.

In this case, the first cooling information may be a setting value of the air conditioner for more rapidly lowering the temperature of the first zone 1111 included in the indoor space in the type A than the temperature of any one of other zones (second zone to twelfth zone 1112 to 1122).

Meanwhile, referring to FIG. 11B, the processor of the air conditioner 700 may receive an input for setting a zone 1151 through the input unit.

In addition, the processor of the air conditioner 700 may perform intensive cooling for the zone set through the input.

In detail, the processor of the air conditioner 700 may obtain cooling information, which corresponds to the zone 1151 set by the user, of the multiple pieces of information corresponding to the plurality of zones 1111, 1112, 1113, 1114, 1115, 1116, 1117, 1118, 1119, 1120, 1121, and 1122, respectively.

For example, the processor of the air conditioner 700 may compare positions of the plurality of zones 1111, 1112, 1113, 1114, 1115, 1116, 1117, 1118, 1119, 1120, 1121, and 1122 and the position of the zone 1151 set by a user.

In addition, the processor of the air conditioner 700 may obtain the seventh zone 1117 nearest to the zone 1151 set by the user, of the plurality of zone 1111, 1112, 1113, 1114, 1115, 1116, 1117, 1118, 1119, 1120, 1121, and 1122. In addition, the processor of the air conditioner 700 may obtain cooling information corresponding to the seventh zone 1117.

The cooling information corresponding to the seventh zone 1117 may be a setting value of the air conditioner to more rapidly lower a temperature of the zone 1151, which is set by the user, in the indoor space, than a temperature of another zone in the indoor space corresponding to the structure of the indoor space.

Accordingly, when the air conditioner 700 operates based on the cooling information corresponding to the seventh zone 1117, the temperature difference between the seventh zone 1117 and another zone may be less than the temperature difference between the seventh zone 1117 and the another zone when the air conditioner 700 operates regardless of the cooling information.

Meanwhile, the multiple pieces of cooling information corresponding to the plurality of zones in the indoor space in the specific type may be determined in advance and stored in the memory.

Since the indoor space has various structures, the optimal cooling manner may be varied depending on the structure of the indoor space. However, according to the present disclosure, the optimal cooling may be performed by considering the structure of the indoor space.

In addition, recently, a cleaning robot or the moving agent, such as a cleaning robot or a guide robot placed in an airport, a shopping mall, or a museum, has been increasingly utilized. In addition, according to the present disclosure, the optimal cooling may be performed after easily detecting the structure of the indoor space using the moving agent.

In addition, according to the present disclosure, the optimal cooling suitable for various purposes may be performed.

For example, according to the present disclosure, as the optimal cooling is performed with respect to the weak cooling zone, the optimal cooling based on the structure of the indoor space may be performed with respect to the zone, the temperature of which is not sufficiently lowered even though the air conditioner operates.

For another example, according to the present disclosure, as the optimal cooling is performed with respect to the main cooling zone, the optimal cooling based on the structure of the indoor space may be performed with respect to the zone in which a human being is positioned frequently or for a long time.

For another example, according to the present disclosure, the average temperature of the whole indoor space may most rapidly reach the target temperature based on the structure of the indoor space.

For another example, according to the present disclosure, the cooling may be performed such that the temperatures of several zones in the indoor space are uniformly maintained as much as possible based on the structure of the indoor space.

Meanwhile, a second embodiment of the present disclosure will be described with reference to FIGS. 12 to 17. In this case, the second embodiment relates to a method for performing the optimal cooling based on the type of the indoor space and the situation information of the indoor space.

Figure 12:
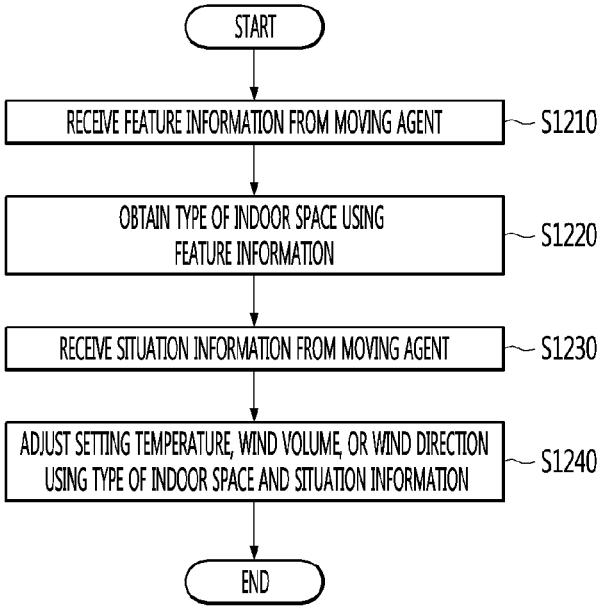
FIG. 12 is a view illustrating a method for operating an air conditioner according to the second embodiment of the present disclosure.

FIG. 12 is a view illustrating the method for operating the air conditioner according to the second embodiment of the present disclosure.

According to an embodiment of the present disclosure, the method for operating the air conditioner may include receiving feature information, which is collected by the moving agent, associated with the structure of the indoor space (S1210), obtaining the type of the indoor space using the received feature information (S1220), receiving situation information including at least one of temperature information for each zone, body temperature information of a member, and heat radiation information, which are collected by the moving agent (S1230), and adjusting at least one of a setting temperature, a wind volume, and a wind direction of the air conditioner using the type of the indoor space and the situation information of the indoor space (S1240).

In this case, the situation information may include the temperature information for each zone. In detail, the indoor space in which the air conditioner and the moving agent are positioned may include a plurality of zones.

In this case, the moving agent may sense the temperature of each of the plurality of zones in the indoor space and transmit the temperature to the air conditioner 700.

In addition, the situation information may include the body temperature information of the member. In detail, the moving agent may sense the body temperature of the user using a heat sensor and transmit the sensed temperature to the air conditioner 700. In this case, the body temperature information may include the body temperature of the member and the position of the member.

In addition, the situation information may include heat radiation information.

In more detail, the control unit of the moving agent may detect a situation in which heat is emitted using various sensors included in the sensor unit 150.

For example, when the gas stove is turned on, the control unit of the moving agent acquires heat radiation information indicating that heat is emitted from a specific location based on a sound, a temperature, and an image captured by a camera, and then may transmit the obtained heat radiation information to the air conditioner 700.

Meanwhile, the processor of the air conditioner 700 may receive situation information and determine a specific zone to perform intensive cooling based on the received situation information. In this case, the specific zone in which intensive cooling is to be performed may refer to a zone in which the level of cooling has to be increased according to the situation information.

Hereinafter, a method for determining the specific zone will be described with reference to FIGS. 13 to 15.

Figure 13:
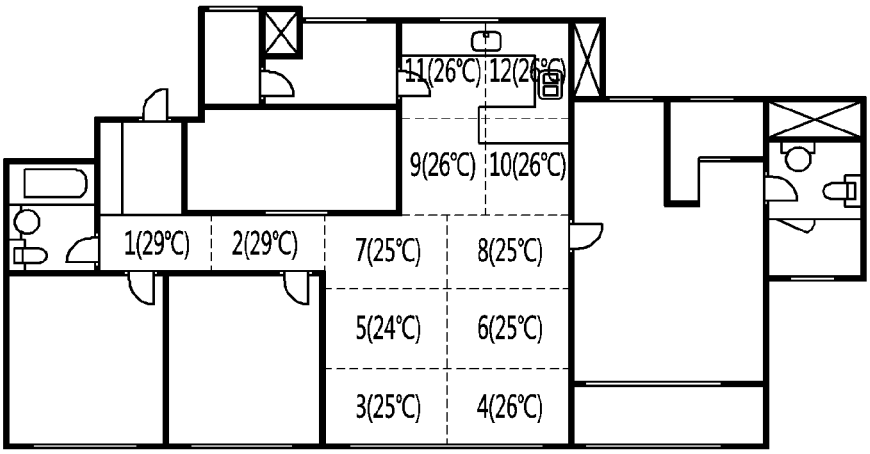
FIGS. 13 to 15 are views illustrating a method for determining the specific zone in which the intensive cooling is to be performed.
Figure 14:
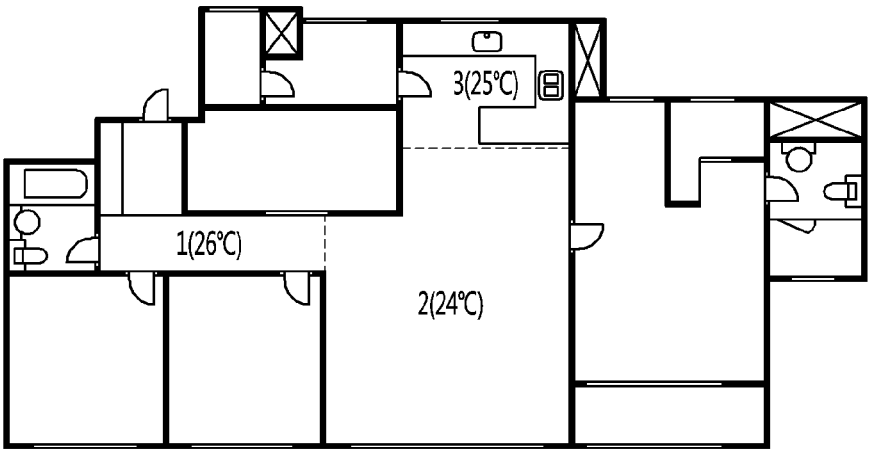
Figure 15:
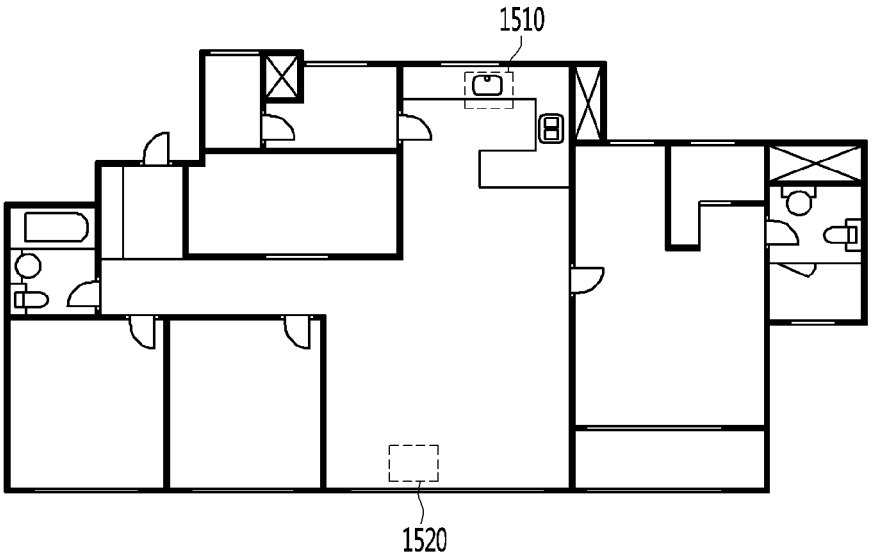

FIGS. 13 to 15 are views illustrating the method for determining the specific zone in which the intensive cooling is to be performed.

The specific zone may be the zone having the highest temperature in the indoor space.

In more detail, referring to FIG. 13, the indoor space may be divided into a plurality of zones 1 to 12. The moving agent may sense the temperatures of the plurality of zones 1 to 12 and transmit the temperatures to the air conditioner 700.

The processor of the air conditioner may determine, as a specific zone, a zone having the highest temperature of the plurality of zone in the indoor space.

For example, when the second zone 2 of the plurality of zones 1 to 12 in the indoor space has the highest temperature, the processor of the air conditioner may set the second zone as a specific zone in which the intensive cooling is to be performed.

Meanwhile, there may be a plurality of zones, which have the highest temperature, among the plurality of zones. For example, the temperatures of the first zone 1 and the second zone 2 may be the same.

In this case, the processor of the air conditioner may set any one of the plurality of zones 1 and 2 having the highest temperature as a specific zone.

Meanwhile, the specific zone may be a zone, the temperature of which fails to reach the target temperature within the indoor space.

In detail, referring to FIG. 14, the indoor space may include the first zone 1 at the first temperature (26° C.), the second zone 2 at the second temperature (24° C.), and the third zone 3 at the third temperature (25° C.)

The processor of the air conditioner may determine, as a specific zone, a zone, the temperature of which fails to reach the target temperature, of a plurality of zones in the indoor space.

Meanwhile, there may be a plurality of zones, the temperatures of which fail to reach the target temperature. For example, when the target temperature is 24° C., the temperatures of the first zone 1 and the third zone 3 fail to reach the target temperature.

In this case, the processor of the air conditioner may set any one of the plurality of zones 1 and 3, the temperatures of which fail to reach the target temperature, as a specific zone.

As another example, the processor of the air conditioner may set, as a specific zone, the zone 1, which has a higher temperature, of the plurality of zones, the temperatures of which fail to the target temperature.

Meanwhile, referring to FIG. 15, a specific zone may be a zone in which a user having a body temperature greater than a preset value is positioned. In this case, the preset value may refer to the normal body temperature of the user.

Meanwhile, the body temperature of the user may be higher than the preset value. For example, the case that the user exercises is the example thereof.

In this case, the processor of the air conditioner may set the zone 1520 in which the user having the body temperature higher than the preset value is positioned, as the specific zone.

Meanwhile, referring to FIG. 15, the specific zone may be a zone in which heat radiation information is shown.

For example, when the gas stove is turned on, the control unit of the moving agent may transmit the heat radiation information, which indicates that heat is emitted from a specific position, to the air conditioner 700.

In this case, the processor of the air conditioner may set, as the specific zone, the zone 1510 indicated by the heat radiation information.

Meanwhile, the processor of the air conditioner 700 may acquire the cooling information, which corresponds to the type of the indoor space, multiple pieces of cooling information corresponding to the types of the plurality of indoor spaces, respectively.

In addition, the processor of the air conditioner 700 may obtain zone cooling information, which corresponds to the specific zone, of multiple pieces of zone cooling information included in the cooling information corresponding to the type of the indoor space.

For example, the processor of the air conditioner 700 may compare the positions of the plurality of zones with the position of the specific zone. The processor of the air conditioner 700 may obtain a zone overlapping with or closest to a specific region of the plurality of zones. In addition, the processor of the air conditioner 700 may acquire zone cooling information corresponding to the acquired zone.

Meanwhile, the processor of the air conditioner 700 may adjust at least one of a setting temperature, a wind volume, or a wind direction of the air conditioner by using zone cooling information corresponding to a specific zone.

The zone cooling information corresponding to the specific zone is a setting value of the air conditioner to more rapidly lower a temperature of the specific zone in the indoor space than a temperature of another zone in the indoor space, corresponding to the structure of the indoor space.

The details thereof will be described with reference to FIG. 16.

Figure 16A:
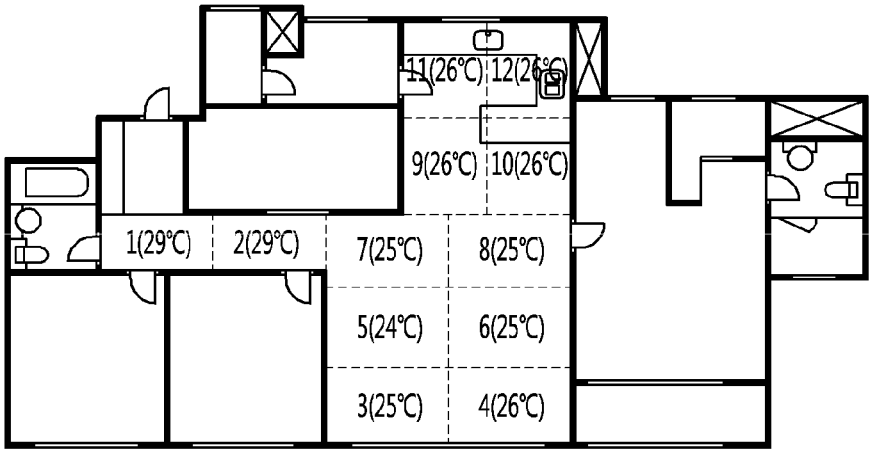
FIG. 16A is a view illustrating the temperature in each zone before the intensive cooling is performed.
Figure 16B:
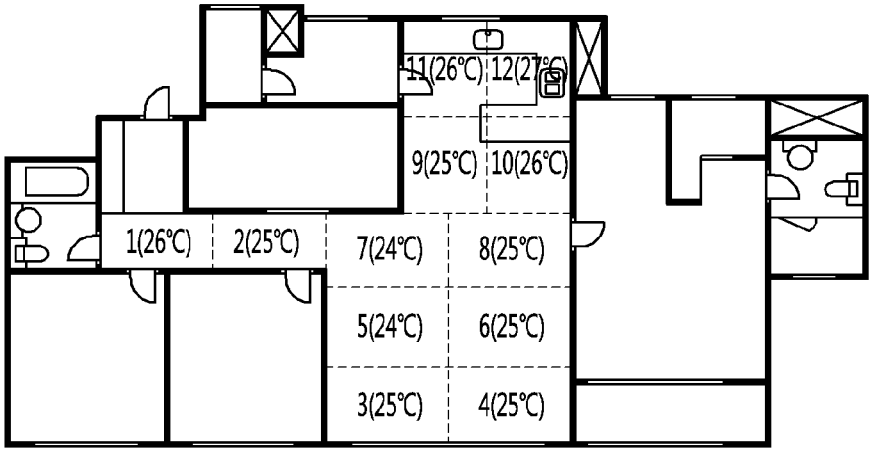
FIG. 16B is a view illustrating the temperature in each zone after the intensive cooling is performed.

FIG. 16A is a view illustrating the temperature in each zone before the intensive cooling is performed, and FIG. 16B is a view illustrating the temperature in each zone after the intensive cooling is performed.

When the intensive cooling is performed with respect to the specific zone (the second zone 2), the temperature of the second zone 2 may be more rapidly lowered than the temperature of another zone in the indoor space.

The temperature of another zone in the indoor space may refer to the temperature of any one of other zones 1 and 3 to 12 in the indoor space.

The temperature of the another zone in the indoor space may refer to the temperature of a preset zone of other zones 1 and 3 to 12 in the indoor space.

The temperature of another zone in the indoor space may refer to the average temperature of other zones 1 and 3 to 12 in the indoor space.

The zone cooling information corresponding to the specific zone as described above may be a setting value of the air conditioner for more rapidly lowering the temperature of the specific zone than the temperature of another zone, as the air discharged from the air conditioner 700 more sufficiently reaches the specific zone directly or through convection current, as compared to another zone.

Accordingly, when the air conditioner 700 operates based on the zone cooling information corresponding to the specific zone, the temperature of the specific zone may be more rapidly lowered than the temperature of the specific zone when the air conditioner 700 operates regardless of the zone cooling information.

Meanwhile, when the specific zone is determined, the processor of the air conditioner 700 may store the information on the determined specific zone in the memory.

In addition, in the next operation of the air conditioner, the processor of the air conditioner 700 may perform the intensive cooling for the specific zone based on the information on the specific zone, which is stored in the memory.

In this case, in the next operation of the air conditioner, the processor of the air conditioner 700 may perform the intensive cooling for the specific zone without the operation of the moving agent.

There may be present a zone in which cooling is habitually weak, due to the structure of the indoor space. For example, the zone in which the cooling is habitually weak may have the temperature higher than that of another zone whenever the air conditioner performs cooling.

In addition, according to the present disclosure, the weak cooling zone is detected using the moving agent and information on the weak cooling zone is stored in the memory. Accordingly, the intensive cooling may be performed with respect to the weak cooling zone without the operation of the moving agent.

Meanwhile, the processor of the air conditioner 700 may perform cooling using cooling information, based on the uniformity of the temperature of the indoor space.

In detail, the processor of the air conditioner 700 may obtain a uniformity of a temperature of the indoor space based on the situation information. In more detail, the processor of the air conditioner may obtain the uniformity of the temperature of the indoor space based on the deviation between the temperatures of the plurality of zones.

When the uniformity is lower than the preset value, the processor of the air conditioner 700 may adjust at least one of the setting temperature, the wind volume, or the wind direction using the cooling information corresponding to the type of the indoor space.

In this case, the cooling information corresponding to the type of the indoor space may be a setting value of the air conditioner to uniformly make a temperature of air in the indoor space, corresponding to the structure of the indoor space.

In other words, the cooling information corresponding to the type of the indoor space may be a setting value of the air conditioner to uniformly make a temperature of air in the whole indoor space as the air discharged from the air conditioner 700 reaches a plurality of zones in the indoor space directly or through the convection current.

It is necessary to determine an area in which intensive cooling is performed based on the situation of the indoor space. However, various sensors are necessary to consider various situations occurring in the indoor space, thereby causing the increase of the costs.

However, according to the present disclosure, after the situation of the indoor space is easily detected using the moving agent, the area requiring the intensive cooling may be determined and the optimal cooling may be performed based on even the structure of the indoor space.

Figure 17:
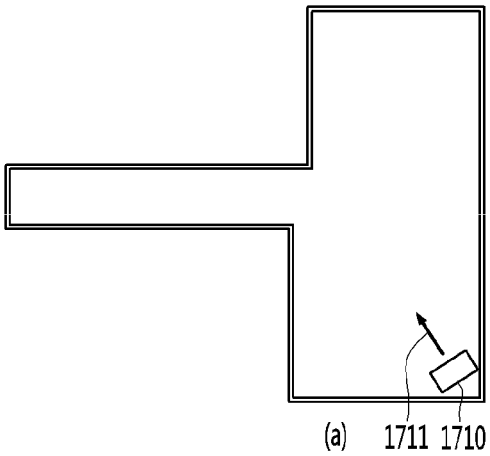
FIG. 17 is a view illustrating a method for correcting cooling information according to an embodiment of the present disclosure.
Figure 17:
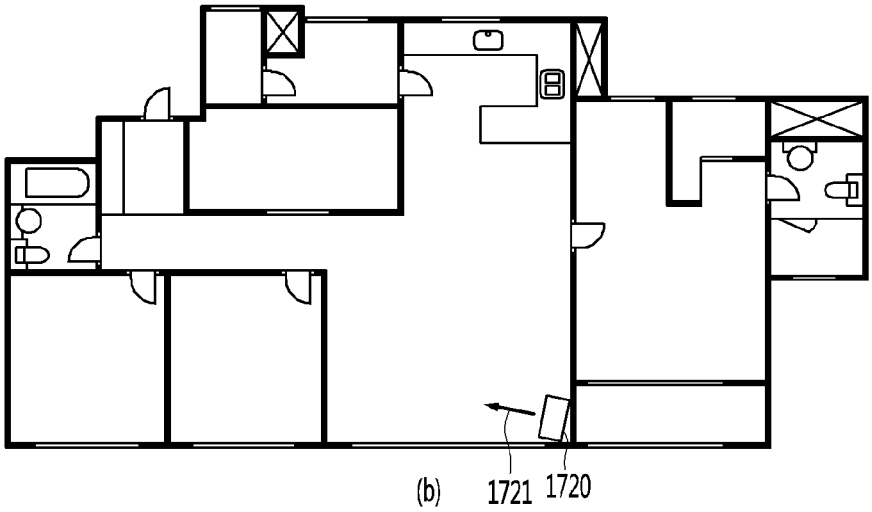

FIG. 17 is a view illustrating a method for correcting cooling information according to an embodiment of the present disclosure.

The processor 780 of the air conditioner 700 may acquire at least one of a position or a direction of the air conditioner in the indoor space based on the feature information.

In detail, the map received from the moving agent or generated by the processor 780 may include information on at least one of the position or the direction of the air conditioner.

FIG. 17A illustrates a specific type of the indoor space corresponding to a real indoor space. In addition, the cooling information corresponding to the specific type may be generated on the assumption that the position and the direction 1711 of the air conditioner 700 are a specific position and a specific direction.

Meanwhile, FIG. 17B illustrates the real indoor space in which the air conditioner and the moving agent are placed. In addition, the position and direction 1721 of the air conditioner 1720 in the actual indoor space may be different from the position and direction 1711 of the air conditioner 1710 in the specific type of FIG. 17A.

Therefore, the processor 780 may correct the cooling information corresponding to the type of the indoor space based on at least one of the position or the direction 1721 of the air conditioner 1720.

In detail, the processor 780 may correct cooling information by comparing between at least one of a position or a direction 1721 of the air conditioner 1720 in an indoor space with at least one of a position or a direction 1711 of the air conditioner 1710 in a specific type corresponding to the indoor space.

The air conditioner may be installed at various positions in various directions. However, according to the present disclosure, the cooling may be performed by exactly applying cooling information through the correction of the cooling information even though the air conditioner is installed at various positions in various directions.

Meanwhile, when the operation of the air conditioner 700 starts, the processor 780 of the air conditioner 700 may transmit a command for collecting situation information to the moving agent.

In addition, when the command for collecting the situation information is received, the moving agent may collect the situation information while moving the indoor space.

As described above, according to the present disclosure, when the operation of the air conditioner 700 starts, the moving agent operates to collect the situation information of the indoor space while performing the cooling.

Meanwhile, the method for acquiring the type of the indoor space using the air conditioner 700 and the cooling information may be realized in the moving agent.

For example, the moving agent may include a driving unit including at least one driving motor, a communication unit to make communication with an air conditioner provided in the indoor space, a sensor unit to obtain situation information, which includes feature information associated with a structure of the indoor space, temperature information of each zone, body temperature information of a user, or heat radiation information, and a processor to obtain a type of the indoor space using the feature information, to obtain cooling information using the type of the indoor space and the situation information, and to transmit the cooling information to an air conditioner.

The above-described invention is able to be implemented with computer-readable codes on a medium having a program. Computer-readable medium includes all types of recording devices having data which is readable by a computer system. For example, the computer-readable medium includes a hard disk drive (HDD), a solid state disk (SSD), a silicon disk drive (SDD), a ROM, a RAM, a CD-ROM, a magnetic tape, a floppy disk, or an optical data storage device. In addition, the computer may include the processor 180 of the server. Accordingly, the detailed description should be understood by way of example instead of being limitedly interpreted in terms of all aspects. The scope of the present disclosure should be determined by the reasonable interpretation of attached claims, and the equivalents of the present disclosure falls within the scope of the present disclosure.

The invention claimed is:

1. An air conditioner provided in an indoor space, the air conditioner comprising:

a compressor;

a casing including an inlet and an outlet;

a fan motor installed inside the casing to ventilate air;

an outlet vane movably provided in the outlet;

a vane motor to operate the outlet vane;

a communicator to make communication with a moving agent moving in the indoor space;

a non-transitory memory; and a processor configured to:

receive feature information associated with a structure of the indoor space, which is obtained by the moving agent;

obtain a type of the indoor space using the feature information;

adjust at least one of a setting temperature, a wind volume, or a wind direction by controlling at least one of operations of the compressor, the fan motor, or the vane motor using the type of the indoor space; and obtain the type of the indoor space based on the structure of the indoor space and a position and a direction of the air conditioner, wherein a cooling information corresponding to the type of the indoor space is determined in advance and stored in the memory, and wherein the processor is further configured to control the cooling by using the cooling information corresponding to the type of the indoor space, among a plurality of pieces of cooling information corresponding to types of a plurality of indoor spaces, respectively.

2. The air conditioner of claim 1, wherein the processor is further configured to:

adjust the at least one of the setting temperature, the wind volume, or the wind direction.

3. The air conditioner of claim 1, wherein the cooling information corresponding to the type of the indoor space is a setting value of the air conditioner to more rapidly lower a temperature of a main cooling zone in the indoor space than a temperature of another zone in the indoor space, corresponding to the structure of the indoor space.

4. The air conditioner of claim 1 wherein the cooling information corresponding to the type of the indoor space is a setting value of the air conditioner to allow an average temperature of the indoor space to rapidly reach a target temperature, corresponding to the structure of the indoor space.

5. The air conditioner of claim 1, wherein the cooling information corresponding to the type of the indoor space is a setting value of the air conditioner to reduce a difference between a temperature of a weak cooling zone in the indoor space and a temperature of another zone in the indoor space, corresponding to the structure of the indoor space.

6. The air conditioner of claim 1, wherein the cooling information corresponding to the type of the indoor space is a setting value of the air conditioner to more rapidly lower a temperature of a zone, which is set by a user in the indoor space, than a temperature of another zone in the indoor space, corresponding to the structure of the indoor space.

7. The air conditioner of claim 1, wherein the cooling information corresponding to the type of the indoor space is a setting value of the air conditioner to uniformly make a temperature of air in the indoor space, corresponding to the structure of the indoor space.

8. The air conditioner of claim 1, wherein the processor is further configured to:

receive situation information, which includes at least one of temperature information of each zone, body temperature information of a user or heat radiation information, collected by the moving agent; and adjust the at least one of the setting temperature, the wind volume, or the wind direction by controlling at least one of operations of the compressor, the fan motor, or the vane motor using the type of the indoor space and the situation information.

9. The air conditioner of claim 8, wherein the processor is further configured to:

determine a specific zone at which intensive cooling is to be performed based on the situation information.

10. The air conditioner of claim 9, wherein the specific zone is zone having the highest temperature in the indoor space.

11. The air conditioner of claim 9, wherein the specific zone is a zone, a temperature of which fails to reach a target temperature.

12. The air conditioner of claim 9, wherein the specific zone is a zone at which a user having a body temperature higher than a preset value is positioned or a zone indicated by the heat radiation information.

13. The air conditioner of claim 9, wherein the processor is further configured to:

obtain zone cooling information, which corresponds to the specific zone, of multiple pieces of zone cooling information included in the cooling information corresponding to the type of the indoor space; and adjust the at least one of the setting temperature, the wind volume, or the wind direction using the zone cooling information corresponding to the specific zone.

14. The air conditioner of claim 13, wherein the zone cooling information corresponding to the specific zone is a setting value of the air conditioner to more rapidly lower a temperature of the specific zone in the indoor space than a temperature of another zone in the indoor space, corresponding to the structure of the indoor space.

15. The air conditioner of claim 9, wherein the processor is further configured to:

store information on the determined specific zone in a memory, and perform intensive cooling for the specific zone based on the stored information on the specific zone, in a next operation of the air conditioner.

16. The air conditioner of claim 9, wherein the processor is further configured to:

transmit a command for collecting the situation information to the moving agent when an operation of the air conditioner is started.

17. The air conditioner of claim 8, wherein the processor is further configured to:

obtain a uniformity of a temperature of the indoor space based on the situation information; and adjust the at least one of the setting temperature, the wind volume, or the wind direction using cooling information corresponding to a type of the indoor space, when the uniformity is lower than a preset value; and wherein the cooling information corresponding to the type of the indoor space is a setting value of the air conditioner to uniformly make a temperature of air in the indoor space, corresponding to the structure of the indoor space.

18. The air conditioner of claim 1, wherein the moving agent is a robot cleaner.

19. A moving agent to move in an indoor space, the moving agent comprising:

a driver including at least one driving motor;

a communicator to make communication with an air conditioner provided in the indoor space;

a sensor to obtain situation information, which includes at least one of feature information associated with a structure of the indoor space, temperature information of each zone, body temperature information of a user, or heat radiation information; and a processor configured to:

obtain a type of the indoor space using the feature information;

obtain cooling information using the type of the indoor space and the situation information; and transmit the cooling information to the air conditioner, wherein the obtaining the type of the indoor space comprises obtaining the type of the indoor space based on the structure of the indoor space and a position and a direction of the air conditioner, wherein the air conditioner comprises a non-transitory memory, wherein the cooling information corresponding to the type of the indoor space is determined in advance and stored in the memory of the air conditioner, and wherein the air conditioner controls the cooling by using the cooling information corresponding to the type of the indoor space, among a plurality of pieces of cooling information corresponding to types of a plurality of indoor spaces, respectively.

* * * * *